United States Patent [19]

List

[11] Patent Number: 4,655,143

[45] **Date of Patent: * Apr. 7, 1987**

[54] ARTICULATED TRUCKS

[75] Inventor: Harold A. List, Bethlehem, Pa.

[73] Assignee: Railway Engineering Associates, Inc., Bethlehem, Pa.

[ * ] Notice: The portion of the term of this patent subsequent to Dec. 26, 1995 has been disclaimed.

[21] Appl. No.: 623,189

[22] Filed: Jun. 21, 1984

Related U.S. Application Data

[63] Continuation-in-part of Ser. No. 948,878, Oct. 5, 1978, Pat. No. 4,455,946, which is a continuation-in-part of Ser. No. 608,596, Aug. 28, 1975, Pat. No. 4,131,069, which is a continuation-in-part of Ser. No. 438,334, Jan. 31, 1974, abandoned.

[51] Int. Cl.[4] ..... B61F 3/08; B61F 5/14

[52] U.S. Cl. ..... 105/168; 105/224.1

[58] Field of Search ..... 105/157, 165, 167, 168, 105/176, 179, 182 R, 199 R, 224.1

[56] References Cited

U.S. PATENT DOCUMENTS

| | | | |
|---|---|---|---|
| 33,167 | 8/1861 | Youmans | 105/176 |
| 220,928 | 10/1879 | Marsters | 105/165 |
| 243,797 | 7/1881 | Robinson | 105/168 |
| 502,503 | 8/1893 | Shaw | 105/176 |
| 555,857 | 3/1896 | Graham | 105/165 |
| 1,640,179 | 8/1927 | Buckwalter | 105/182 R |
| 1,707,046 | 3/1929 | Boyden | 105/165 |
| 1,744,986 | 1/1930 | Richards | 105/168 X |
| 1,772,928 | 8/1930 | Kijlstra | 105/168 X |
| 2,042,623 | 1/1936 | Montrose-Oster | 105/169 |
| 2,296,106 | 9/1942 | Holland et al. | 105/167 |
| 2,360,061 | 10/1944 | Jones | 105/167 |
| 3,274,955 | 9/1966 | Thomas | 105/224.1 |
| 3,528,374 | 9/1970 | Wickens | 105/165 X |
| 3,690,271 | 9/1972 | Hobbs | 105/167 X |
| 3,782,294 | 1/1974 | Sundby | 105/182 R |
| 3,789,770 | 2/1974 | List | 105/168 |
| 3,817,188 | 6/1974 | Lich | 105/224.1 |
| 3,862,606 | 1/1975 | Scales | 105/167 |
| 3,948,188 | 4/1976 | Zehnder | 105/224 R X |
| 4,003,316 | 1/1977 | Monselle | 105/167 |
| 4,067,261 | 1/1978 | Scheffel | 105/182 R X |
| 4,067,262 | 1/1978 | Scheffel | 105/168 |
| 4,131,069 | 12/1978 | List | 105/168 |
| 4,134,343 | 1/1979 | Jackson | 105/167 |
| 4,147,237 | 4/1979 | Mulcahy | 105/168 |
| 4,221,172 | 9/1980 | Sobolewski | 105/168 |
| 4,356,775 | 11/1982 | Paton et al. | 105/218 A |

FOREIGN PATENT DOCUMENTS

| | | | |
|---|---|---|---|
| 450709 | 1/1972 | Australia | 105/168 X |
| 642321 | 6/1962 | Canada | 105/168 |
| 698023 | 11/1964 | Canada | 105/168 |
| 799724 | 11/1968 | Canada | 105/168 |

OTHER PUBLICATIONS

List, H. A., An Evaluation of Recent Developments in Rail Car Truck Design, Apr. 21, 1971, American Society Mechanical Engineers Publication.

*Primary Examiner*—Louis J. Casaregola

*Attorney, Agent, or Firm*—Kenneth P. Synnestvedt

[57] ABSTRACT

A vehicle truck embodying articulated subtrucks or steering arms having a plurality of wheelsets, with steering arm interconnections establishing coordinated steering motions of the wheelsets, the truck also having elastic restraining devices for stabilizing steering and other motions of the wheelsets and still further having linkage interrelating relative lateral motions of the truck and body of the vehicle. A method and structure is provided for adapting or "retrofitting" existing truck structures in a manner to embody the steering and stabilizing characteristics.

14 Claims, 45 Drawing Figures

Fig. 9.
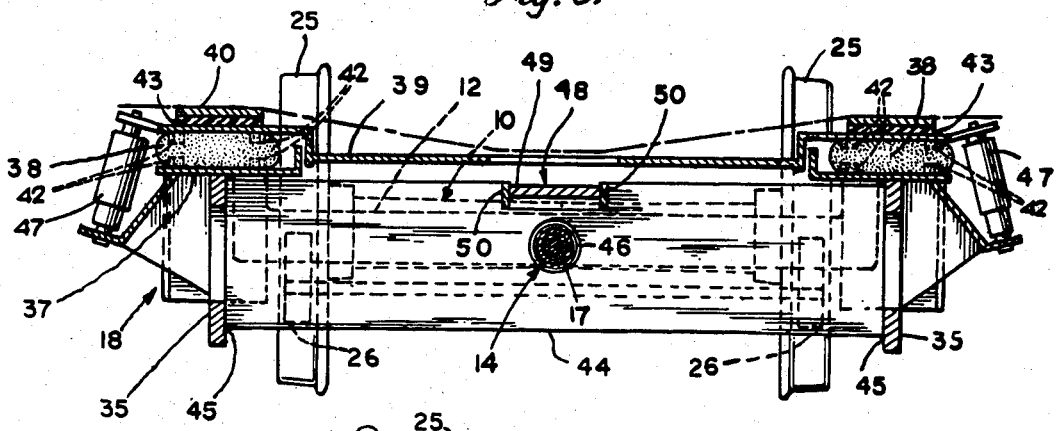
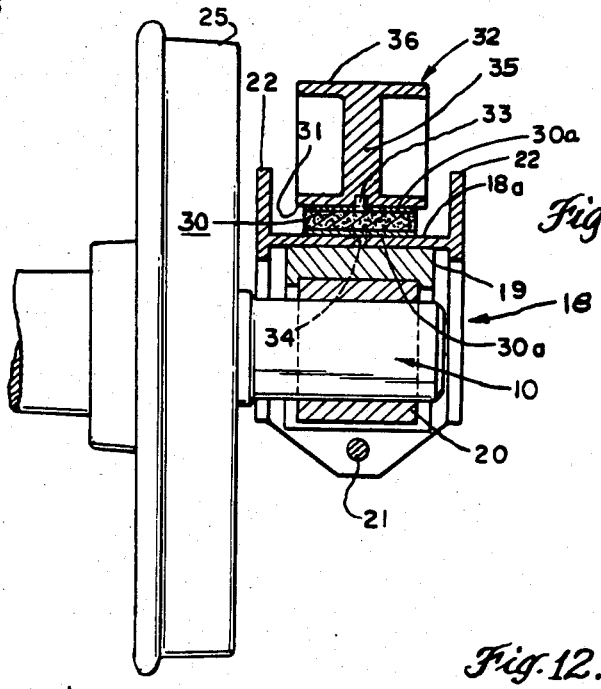
Fig. 10.
Fig. 11.
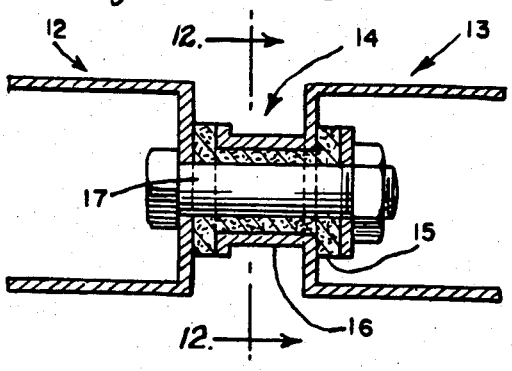
Fig. 12.
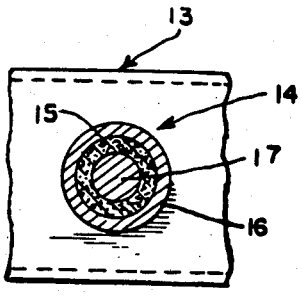

Fig. 13.
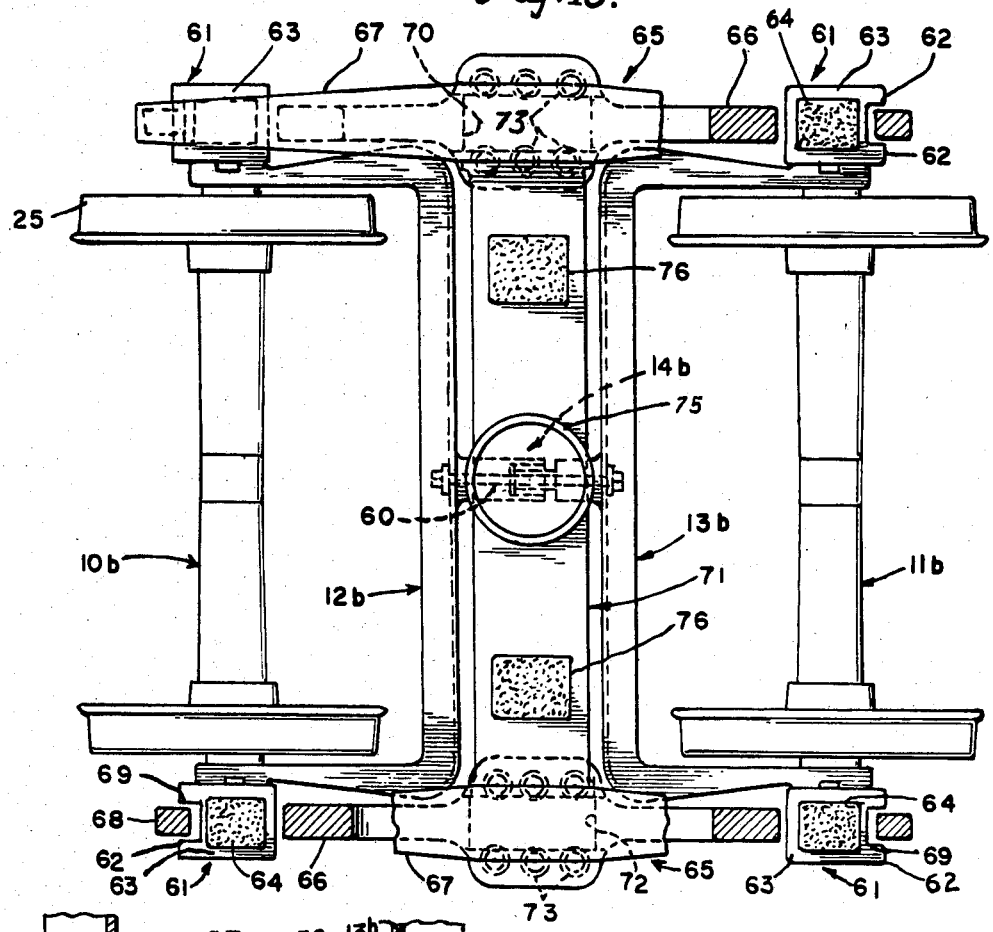
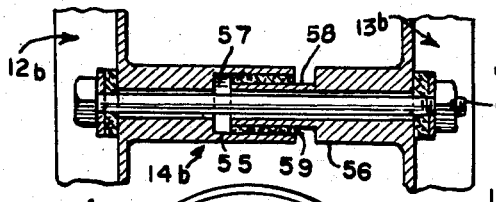
Fig. 15.
Fig. 14.
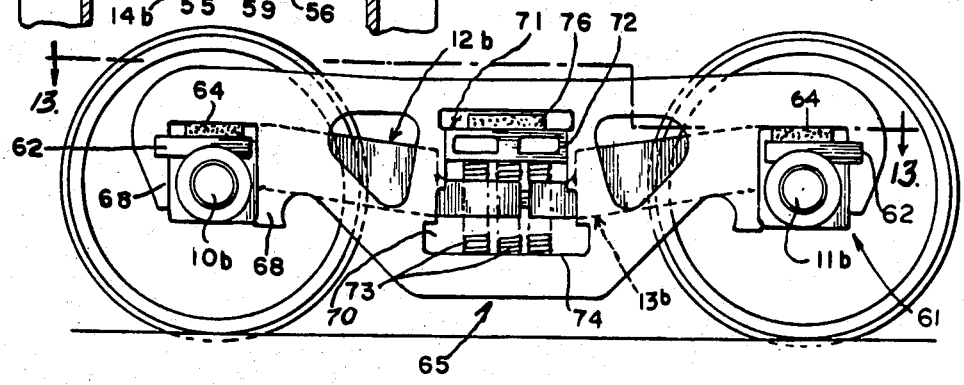

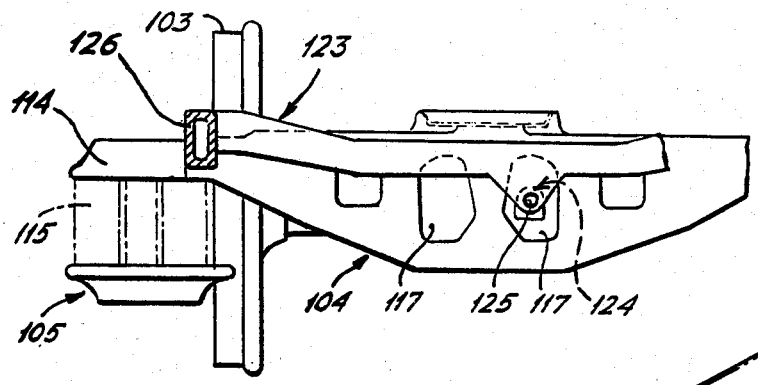
FIG. 18.
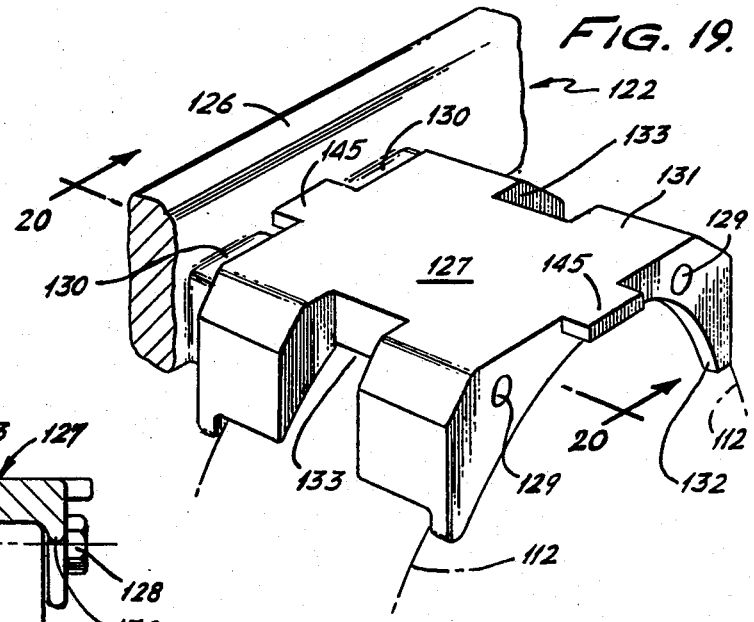
FIG. 19.
FIG. 20.
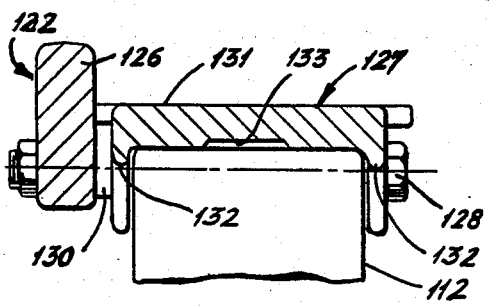
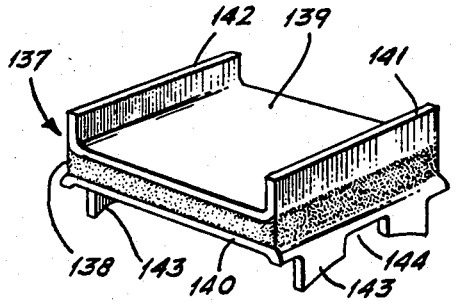
FIG. 22.
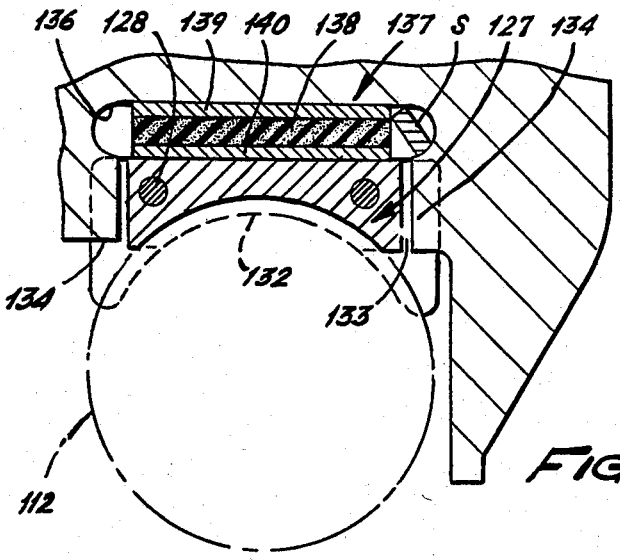
FIG. 21.

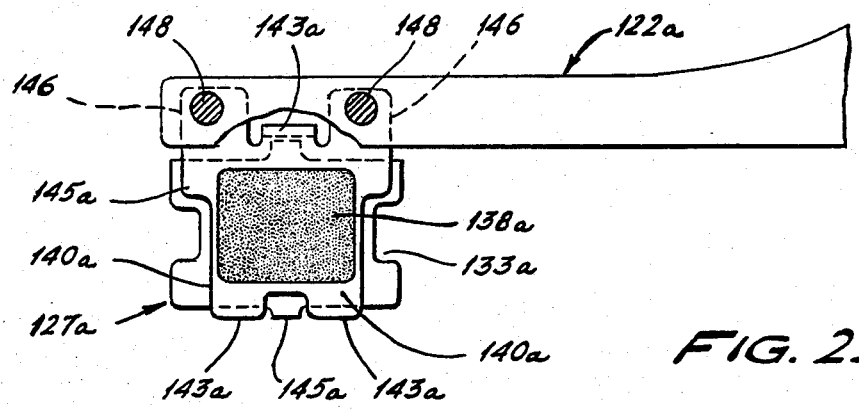
FIG. 23.
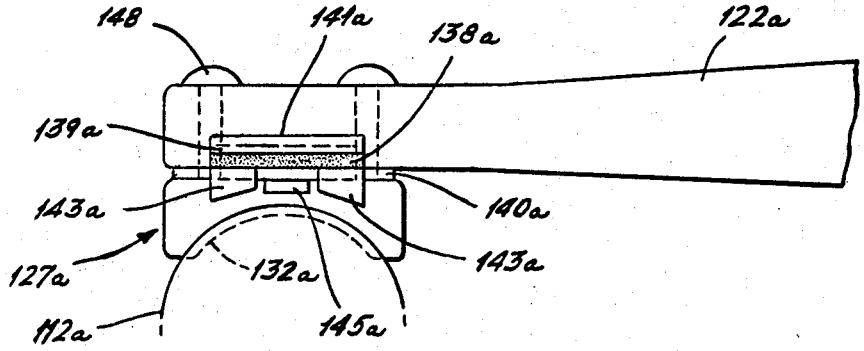
FIG. 24.
FIG. 25.
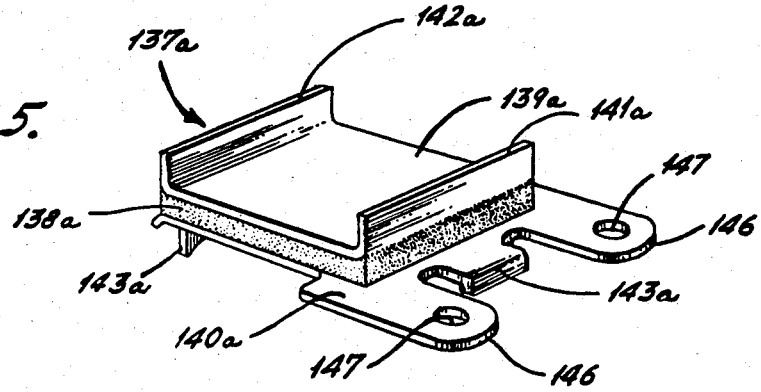

FIG. 34
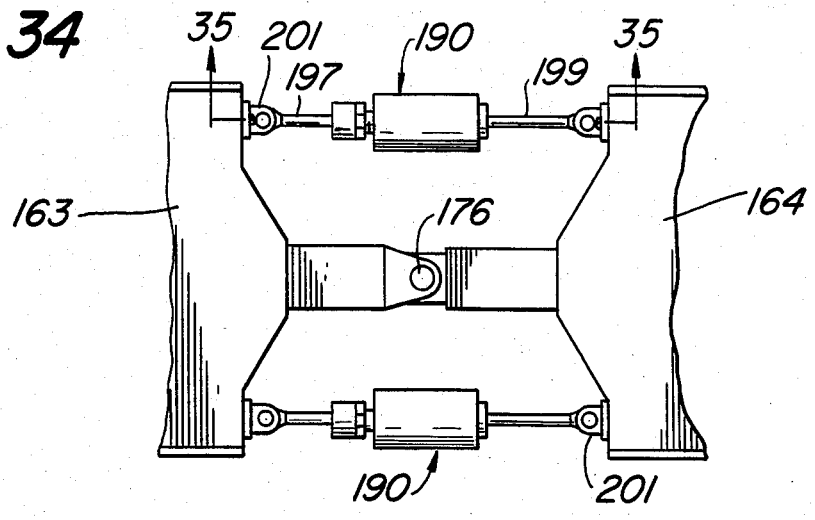
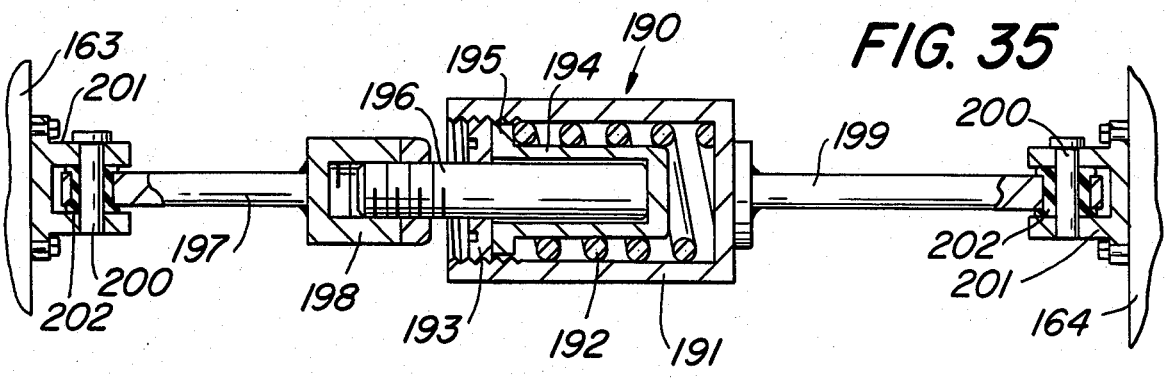
FIG. 35
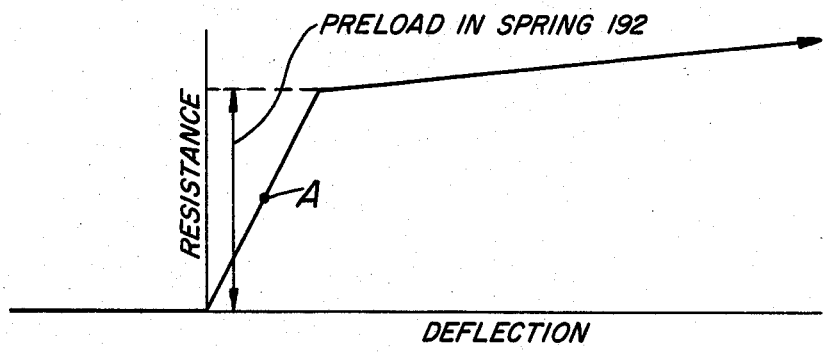
FIG. 36

ARTICULATED TRUCKS

CROSS REFERENCES

This application is a continuation-in-part of my copending application Ser. No. 948,878, filed Oct. 5, 1978 (U.S. Pat. No. 4,455,946), which is a continuation-in-part of my prior application Ser. No. 608,596, filed Aug. 28, 1975, and issued Dec. 26, 1978 as U.S. Pat. No. 4,131,069, and which is a continuation-in-part of my prior application Ser. No. 438,334, filed Jan. 31, 1974, now abandoned, which patent and applications are continuations or continuations-in-part of a group of prior applications, as completely identified in said application Ser. No. 608,596.

TABLE OF CONTENTS OF SPECIFICATION

CROSS REFERENCES
BACKGROUND AND SUMMARY OF THE INVENTION
Vehicle Balance Speed
BRIEF DESCRIPTION OF THE DRAWINGS
Force and Motion Diagrams
First Embodiment
Second Embodiment
Third Embodiment
Fourth Embodiment
Prior Art AAR Truck
First Embodiment Steering Action
Fifth Embodiment and Its Steering Action
Sixth Embodiment
DETAILED DESCRIPTION
Force and Motion Diagrams
First Embodiment
First Embodiment Steering Action
Second Embodiment
Prior Art AAR Truck
Third Embodiment and Retrofitting
Fourth Embodiment and Retrofitting
Brake Rigging
Fifth Embodiment
Fifth Embodiment Steering Action
Sixth Embodiment
SUMMARY

BACKGROUND AND SUMMARY OF THE INVENTION:

In one aspect, the present application is concerned with the adaptation of many features of the parent applications referred to above to existing trucks. By virtue of such adaptation or "retrofitting", it is not necessary, in order to utilize features of the invention, to completely replace existing railroad trucks.

The adaptation or "retrofit" arrangements provided by the present invention have much background, objects and advantages in common with the arrangements of the parent application above referred to; and many of these features are set out herebelow, in addition to the retrofit technique and features, all of which are described and explained fully hereinafter.

In another aspect, the present application is concerned with linkage between the body and certain truck parts, in combination with various other features of the improved trucks disclosed as will be fully explained hereinafter.

While of broader applicability, for example in the field of highway vehicles where use of certain features of the invention can reduce lateral scrubbing of tires as well as lessening the width of the roadway required for negotiating curves, various aspects of my invention are especially useful in railway vehicles and particularly railway trucks having a plurality of axles. Accordingly, and for exemplary purposes, the invention will be illustrated and described with specific reference to railway rolling stock.

The axles of the railway trucks now in normal use remain substantially parallel at all times (viewed in plan). A most important consequence of this is that the leading axle does not assume a position radial to a curved track, and the flanges of the wheels strike the curved rails at an angle, causing objectionable noise and excessive wear of both flanges and rails.

Much consideration has been given to the avoidance of this problem, notably the longstanding use of wheels the treads of which have a conical profile. This expedient has assisted the vehicle truck to negotiate very gradual curves.

However, as economic factors have led the railroads to accept higher wheel loads and operating speeds, the rate of wheel and rail wear becomes a major problem. A second serious limitation on performance and maintenance is the result of excessive, and even violent, oscillation of the trucks at high speed on straight track. In such "nosing", or "hunting", of the truck the wheelsets bounce back and forth between the rails. Above a critical speed hunting will be initiated by any track irregularity. Once started, the hunting action will often persist for miles with flange impact, excessive roughness, wear and noise, even if the speed be reduced substantially below the critical value.

In recent efforts to overcome the curving problem, yaw flexibility has been introduced into the design of some trucks, and arrangements have even been proposed which allow wheel axles of a truck to swing and thus to become positioned substantially radially of a curved track. However, such efforts have not met with any real success, primarily because of lack of recognition of the importance of providing the required lateral restraint, as well as yaw flexibility, between the two wheelsets of a truck, to prevent high speed hunting.

For the purposes of this invention, yaw stiffness can be defined as the restraint of angular motion of wheelsets in the steering direction, and more particularly to the restraint of conjoint yawing of a coupled pair of wheelsets in a truck. The "lateral" stiffness is defined as the restraint of the motion of a wheelset in the direction paralleling its general axis of rotation, that is, across the line of general motion of the vehicle. In the apparatus of the invention, such lateral stiffness also acts as restraint on differential yawing, of a coupled pair of wheelsets.

The above-mentioned general problems produce many particular difficulties all of which contribute to excessive cost of operation. For example, there is deterioration of the rail, as well as widening of the gauge in curved track. In straight track the hunting, or nosing, of the trucks causes high dynamic loading of the track fasteners, and of the press fit of the wheels on the axles, with resultant loosening and risk of failure. A corresponding increased cost of maintenance of both trucks and cars also occurs. As to trucks, mention may be made, by way of example, to flange wear and high wear rates of the bolster and of the surfaces of the side framing and its bearing adapters.

As to cars, there occurs excessive center plate wear, as well as structural fatigue and heightened risk of derailment resulting from excessive flange forces. The effects on power requirements and operating costs, which result from wear problems of the kinds mentioned above, will be evident to one skilled in this art.

In brief, the lack of recognition of the part played by yaw and lateral stiffness has led to: (a) flange contact in nearly all curves; (b) high flange forces when flange contact occurs; and (c) excessive difficulty with lateral oscillation at high speed. The wear and cost problems which result from failure to provide proper values of yaw and lateral stiffness, and to control such values, will now be understood.

It is the general objective of my invention to overcome such problems by the use of self-steering wheelsets in combination with novel apparatus which maintains stability at speed, and to this end I utilize an articulated, self-steering, truck having novelly formed and positioned elastic restraint means which makes it possible to achieve flange-free operation in gradual curves, low flange forces in sharp curves, and good high speed stability.

I have further discovered that application of certain principles of this invention to highway vehicles not only reduces tire scrubbing and highway space requirements, as noted above, but also promotes good stability at high speed.

To achieve these general purposes, and with particular reference to railway trucks, the invention provides an articulated truck so constructed that: (a) each axle has its own, even individual, value of yaw stiffness with respect to the truck framing; (b) such lateral stiffness is provided as to ensure the exchanging of steering moments properly between the axles and also with the vehicle body; and (c) the proper value of yaw stiffness is provided between the truck and the vehicle.

An embodiment representative of the invention has been tested at more than eighty miles per hour, with virtually no trace of instability. With another embodiment, radial curving has been observed at less than 50 foot radius, and flange-free operation is readily achieved with all embodiments on curves of at least 4 degrees.

With more particularity, it is an objective flexibly to restrain yawing motion of the axles by the provision of restraining means of predetermined value between the side frames and the steering arms of a truck having a pair of subtrucks coupled through steering arms rigidly supporting the axles. Elastomeric means for this purpose are provided between the axles and the adjacent side frames, preferably in the region of the bearing means. Such means may be provided at one or both axles of the truck. If provided at both axles, it may have either more or less restraint at one axle, as compared with the restraint at the other, depending upon the requirements of the particular truck design.

It is a further object of this invention to provide elastomeric restraining means in the region of the coupling between the arms to damp lateral axle motions, which results in so-called "differential" yawing of a coupled pair of subtrucks.

The invention is also featured by certain tow bar improvements which take care of longitudinal forces between the car body and the flexibly mounted wheelsets. This arrangement has several advantages, discussed hereinafter, one of which is to prevent excessive deflections, in the elastomeric pads which mount the steering arms to the side frames and the side frames to the car body.

In connection with the use of tow bar arrangements, the invention contemplates employment of various different forms of linkages, in some instances comprising a single tow bar pivotally connected with various parts such as a steering arm, the truck framing or bolster, and the body of the vehicle. In addition, multiple tow bar arrangements may also be employed, with various parts of the multiple linkage pivotally connected with various parts, such as a steering arm, the truck framing or bolster and the car body.

In many of such tow bar linkage arrangements the linkage or tow bar elements absorb or take care of longitudinal forces between the car body and the steering arms or sub-trucks, thereby taking care of forces arising, for example from coupling impacts and also from braking.

Whether or not the linkages are arranged to assume the function of a tow bar, the invention contemplates geometric arrangement of such linkages so that the linkage contributes to the desired overall self-steering action of the truck contemplated by the present invention. In considering this aspect of the linkages disclosed and claimed in the present application, it is pointed out that with wheels having conical treads as is employed virtually universally in railroad trucks, when the truck enters a section of curved track the coordinated steering forces which are established by pivotal interconnection of the steering arms or sub-trucks tend to cause the two wheelsets of the truck to assume radial positions in traversing the curve. The invention contemplates the arrangement of the linkage interconnecting the wheelsets, truck framing and car body so that the linkage, under certain conditions, will contribute to the desired steering action of the interconnected steering arms for the two wheelsets.

Vehicle Balance Speed

The term "Balance Speed" is commonly used to identify the speed of a vehicle on a curved track or rail path at which the body of the vehicle is not displaced laterally either outwardly or inwardly with respect to the curve. The Balance Speed for any given vehicle depends not only upon the speed of travel of the vehicle but also upon the radius of curvature of the track and still further upon the banking or elevation of the outer rail as compared with the inner rail.

In the case of a conventional truck not having self-steering characteristics, the flange of the wheel of the leading axle on the outer side of the curve will tend to engage the outer rail, and this flange-rail contact will tend to increase with increase in speed above the Balance Speed. Above the Balance Speed, the springing (frequently referred to as the secondary springing) between the truck framing and the car body will be displaced or deflected under the influence of the outward lateral motion of the vehicle body on the curve. At the Balance Speed, no appreciable tendency for the vehicle body to the shift either outwardly or inwardly will be present. Below the Balance Speed, the vehicle will tend to shift inwardly with respect to the curve.

The above lateral shift will have some effect with a standard non-steering truck on the location of the wheel flanges with respect to the rails, but with a conventional non-steering type of truck, fluctuations of the speed above or below the Balance Speed will not have substantial influence on the lateral wheel-rail flange forces because with the conventional truck, the wheel-rail flange force is primarily a function of the angle of attack. Because of this, a derailment hazard is present with the standard or non-steering type of truck at low speeds in a curve, especially when travelling below the Balance Speed because the lateral flange force is not reduced and at the same time the vertical load is reduced. Because of this, with a standard non-steering truck, it becomes easier for the flange to climb over the rail and cause derailment and even overturning of the vehicle.

With a steering type of truck, as disclosed herein, even without linkage interconnecting the body of the vehicle with the steering arms, the angle of attack problem is greatly reduced when travelling either at, above or below the Balance Speed. At the Balance Speed, the wheelsets assume generally radial positions with the steering type of truck herein disclosed. At speeds appreciably above the Balance Speed, the flanges of the wheels on the outer rail may come in contact with the outer rail; and at speeds appreciably below the Balance Speed, the flanges of the inner wheels may come in contact with the inner rail. As will be explained more fully here below, the present invention not only provides steering arms interconnected between the wheelsets but further provides a linkage system including linkage elements so coupled with the interconnected steering arms as to provide for modification of the coordinated radial steering action of the intercoupled wheelsets under the influence of the lateral forces arising when the vehicle is travelling on a curve at a speed other than the Balance Speed, i.e., under conditions in which the body of the vehicle is displaced either outwardly or inwardly with respect to the curve. Preferably the linkage is arranged to partially counteract the steering action of the interconnected wheelsets when the vehicle is traversing a curve at a speed higher than the Balance Speed or when the body of the vehicle is displaced outwardly with respect to the rails, and to increase the steering action of the interconnected wheelsets when the vehicle is traversing a curve at a speed lower than the Balance Speed. As will be more fully explained hereinafter, this is particularly important in eliminating the tendencies to flange climbing derailment which is present when a conventional vehicle truck is traversing a curve well below the Balance Speed.

It has been found that this interrelation between the steering action of the interconnected steering arms and the forces introduced from the linkage interconnecting the truck framing and the body of the vehicle also results in more stable action of the truck and vehicle body when traversing straight track at high speeds. Tendencies for the trucks and vehicles to oscillate and hunt at high speeds on straight track is greatly diminished by employment of linkages arranged as above-referred to.

In accordance with another feature of the invention, a special sliding bearing surface is provided between the truck side frames and the car body, further to limit the flange forces in very sharp curves.

My invention also contemplates brake improvements which, when used in conjunction with articulated trucks characteristic of this invention, virtually eliminate contact of the brake shoes with the wheel flanges. Prior to the invention such contact has resulted in substantial wear and in uneven braking.

An important feature of the present invention is the provision of a novel technique for retrofitting existing trucks to provide for the steering of the wheelsets. Thus, an important characteristic of this invention is the fact that it may readily be applied to existing trucks, for example to the 100 ton roller bearing, freight truck design of the Association of American Railroads. Accordingly, one embodiment of the invention, herein disclosed and claimed, teaches the retrofitting of the AAR truck with self-steering wheelsets combined with the stabilizing elastomeric coupling and restraining means characteristic of my invention.

BRIEF DESCRIPTION OF THE DRAWINGS

In the drawings, certain aspects of the invention are shown schematically in FIGS. 1–4. In addition, six structural embodiments representative of my invention are illustrated. A first appears in FIGS. 5–12; a second in FIGS. 13–15; a third in FIGS. 16–22; a fourth in FIGS. 23–25; a fifth in FIGS. 29–32; and a sixth in FIGS. 33–35. Each of these six embodiments utilizes various of the principles and features taught in more general terms in FIGS. 1–4, and the third and fourth embodiments are particularly concerned with the retrofitted trucks as mentioned above. The drawings also include three figures (26–28) showing the AAR truck. These figures are labelled "Prior Art" and will assist in understanding the simple yet effective way in which the invention may be applied to such a truck, while utilizing most of the truck parts with a minimum of modification. With further general reference to the drawings, the individual figures and the various groups and embodiments mentioned above are identified as follows.

Force and Motion Diagrams

First Embodiment

Figure 1:
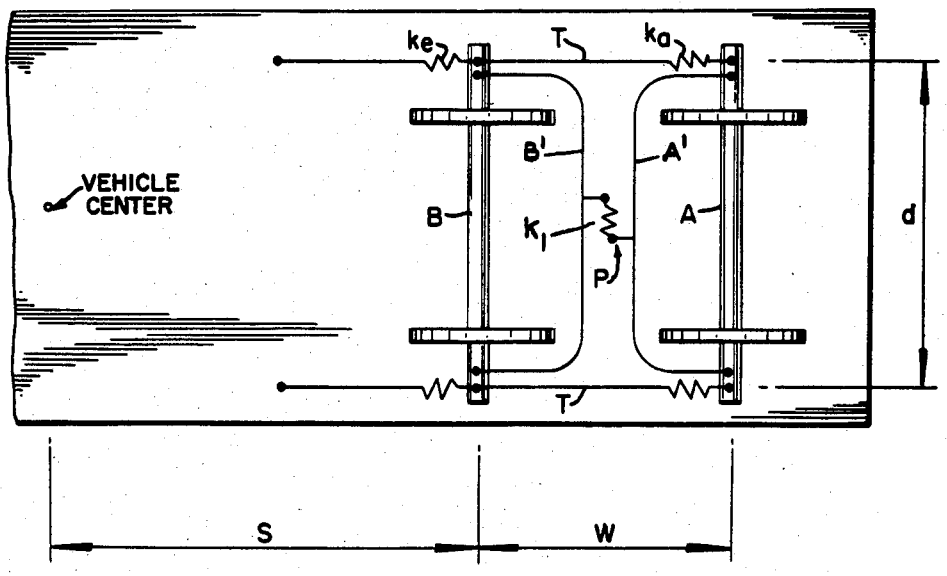
FIG. 1 is a schematic showing of the invention, and illustrating a railway vehicle having truck means which include a pair of wheelsets coupled and damped in accordance with principles of the invention.
Figure 4:
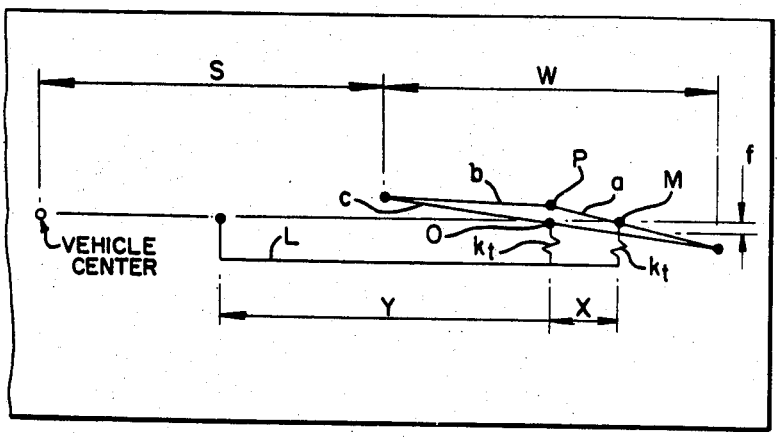
FIG. 4 is a force diagram analyzing the response of a truck generally similar to that shown in FIG. 1, and including in addition a steering link or tow bar.
Figure 5:
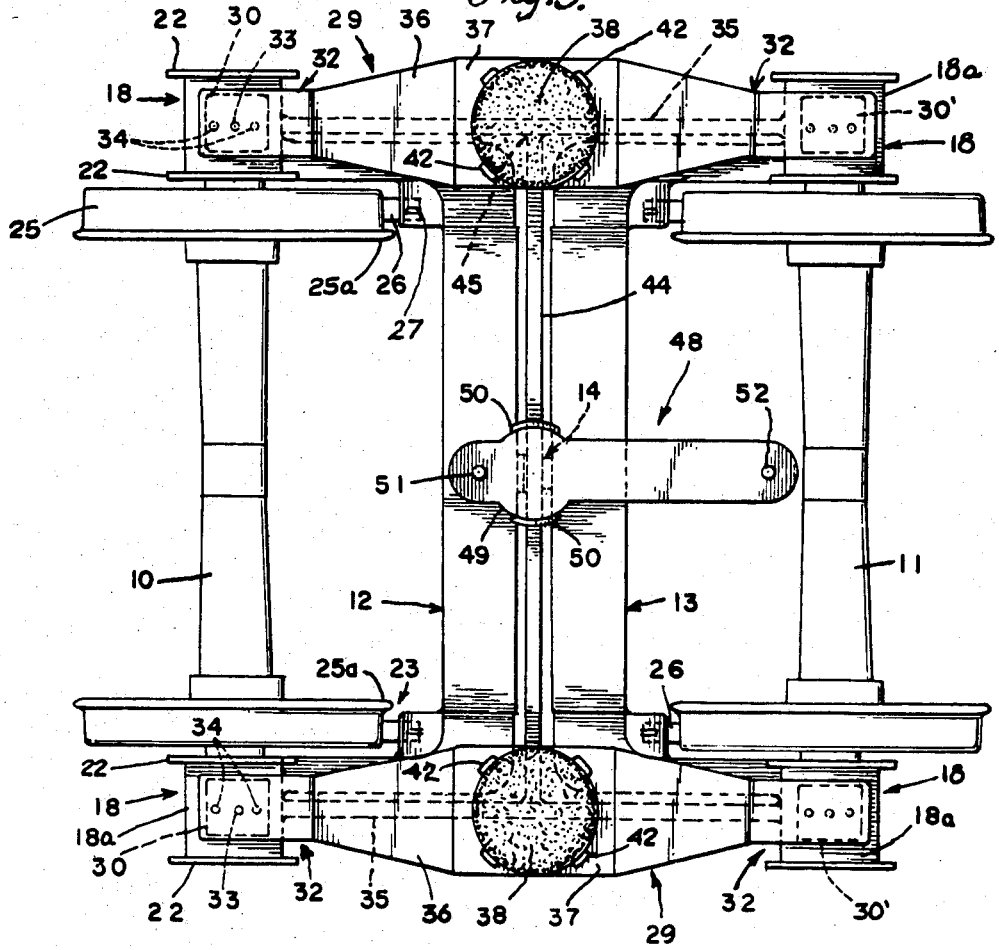
Figure 6:
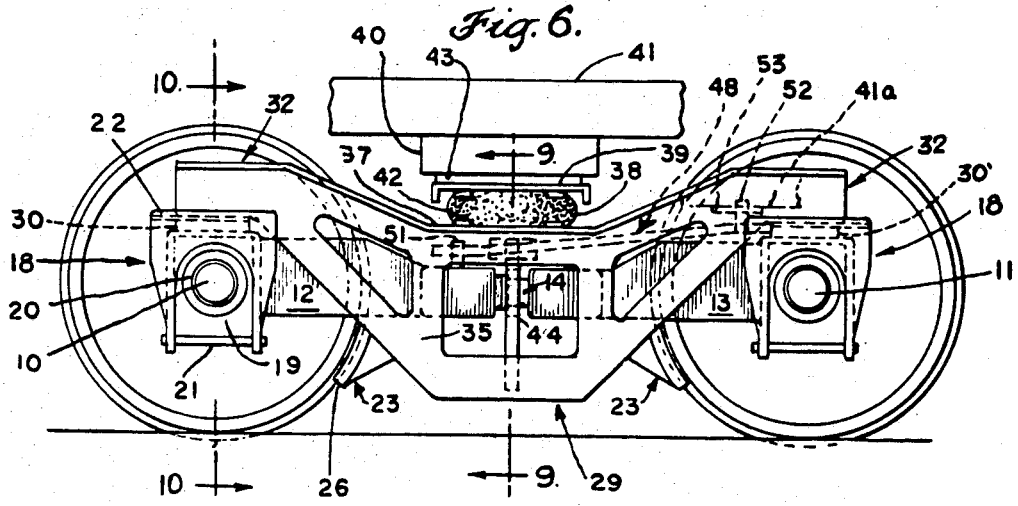
Figure 7:
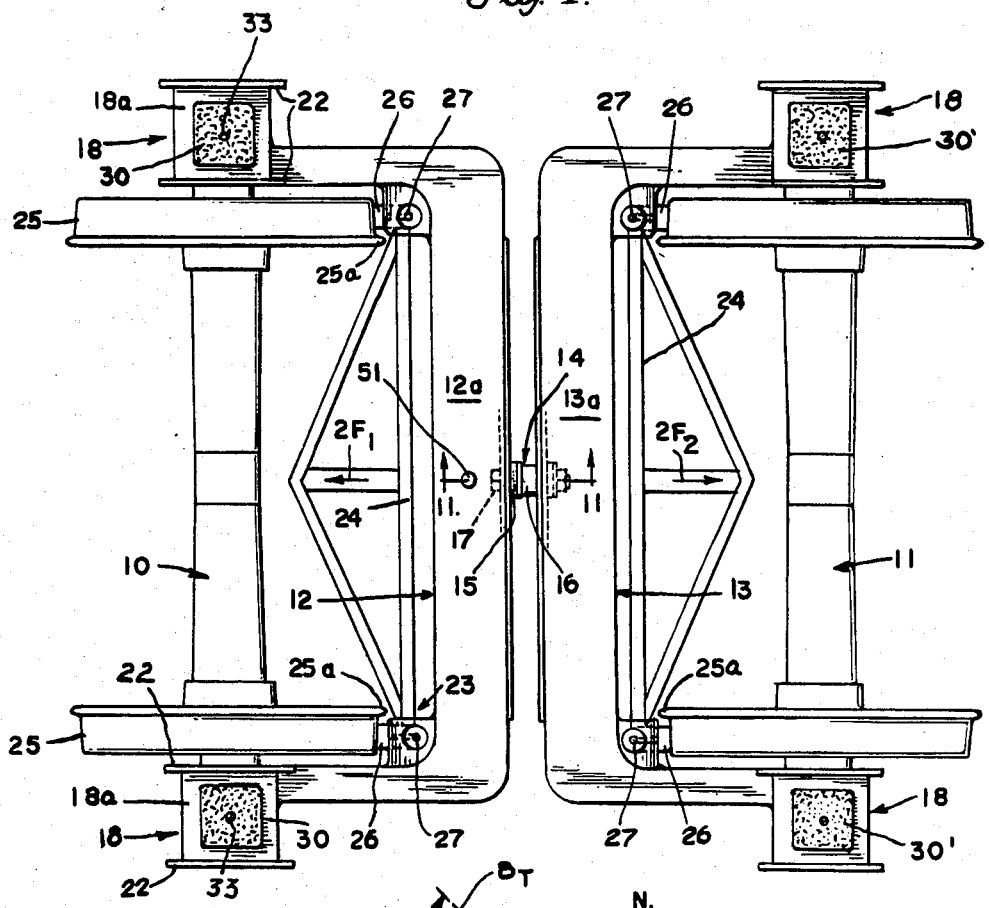
Figure 8A:
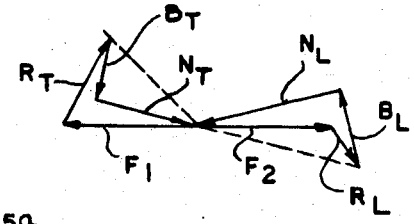
Figure 8:
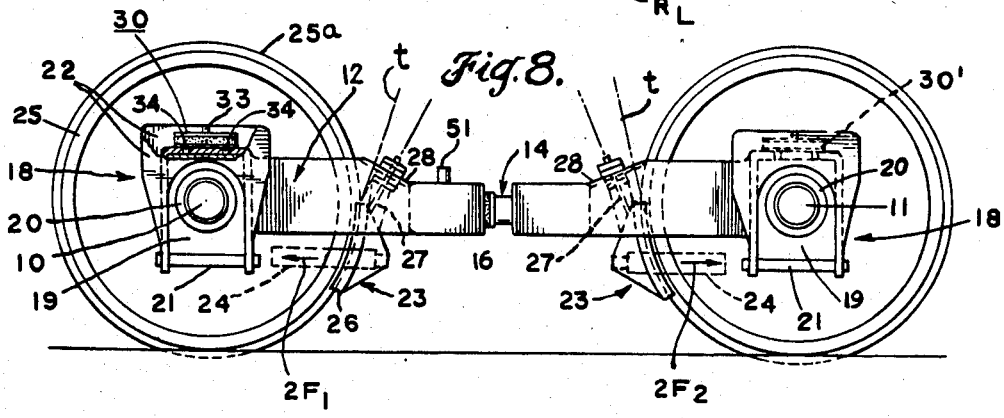

FIG. 5 is a plan view of the first structural embodiment referred to above and shows a railway truck constructed in accordance with the invention, and embodying principles illustrated schematically in FIGS. 1 and 4;

FIG. 6 is a side elevational view of the apparatus shown in FIG. 5;

FIG. 7 is a plan view of the railway truck of FIGS. 5 and 6 with certain upper parts omitted, in order more clearly to show the steering arms, their central connection, and features of brake rigging;

FIG. 8 is a side elevational view of the apparatus shown in FIG. 7;

FIG. 8*a* is a force polygon illustrating the functioning of the brakes;

FIG. 9 is a cross-sectional view taken on the line 9—9 of FIG. 6;

FIG. 10 is an enlarged cross-sectional view of the journal box structure taken on the line 10—10 of FIG. 6;

FIG. 11 is an enlarged sectional view of the central connection of the steering arms taken on the line 11—11 of FIG. 7;

FIG. 12 is a cross section taken on the line 12—12 of FIG. 11;

Second Embodiment

FIG. 13 is a plan view illustrating the second structural embodiment of a railway truck, and uses side frame and bolster castings somewhat similar to those used in conventional freight car trucks;

FIG. 14 is a side elevational view of the apparatus of FIG. 13;

FIG. 15 is an enlarged sectional plan view of the central connection device of the steering arms of the truck of FIGS. 13 and 14;

Third Embodiment

Figure 16:
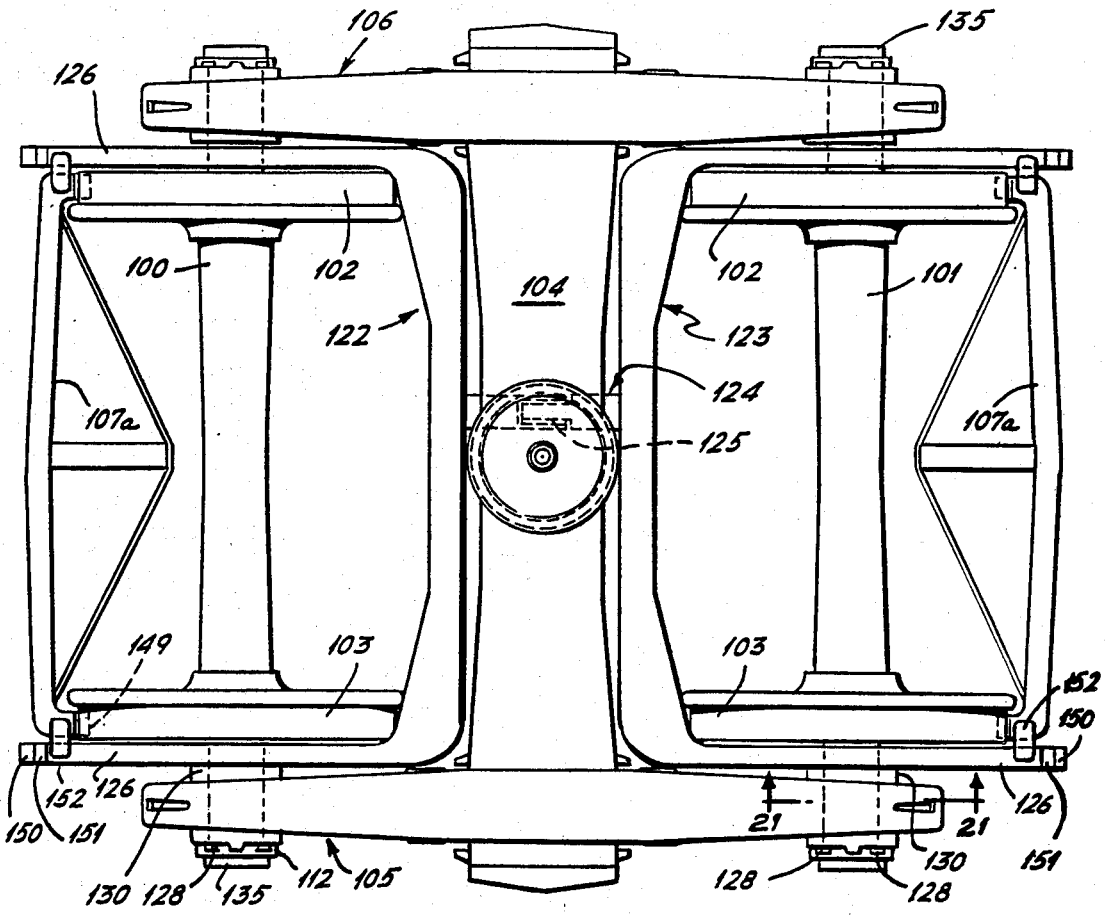
Figure 17:
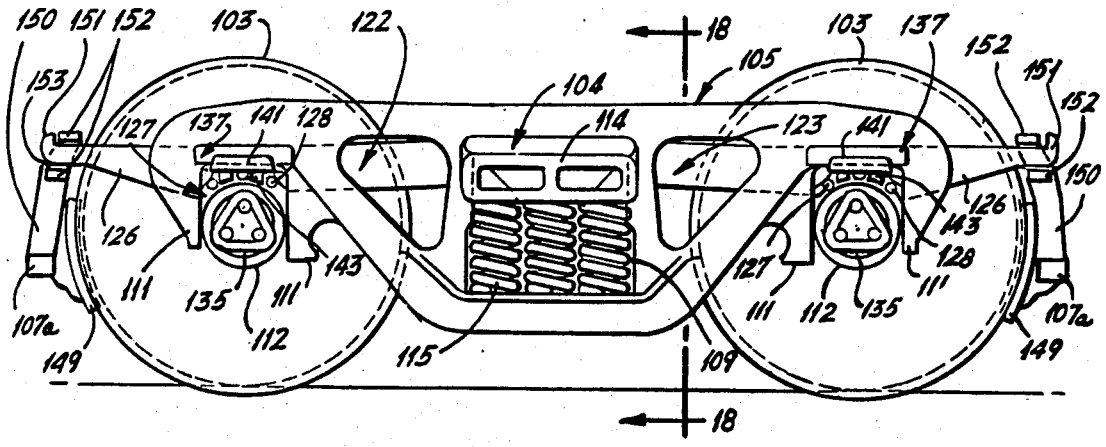

FIGS. 16, 17 and 18 are, respectively, plan, side and sectional views of the mentioned third structural embodiment of the invention;

FIGS. 19–22 are views showing details of the apparatus appearing in FIGS. 16–18, on a larger scale, two of these detail views being in perspective;

Fourth Embodiment

FIGS. 23 and 24 are, respectively, partial plan and side views of the apparatus of the fourth embodiment, and FIG. 25 is a perspective showing of a part of that apparatus;

Prior Art AAR Truck

Figure 26:
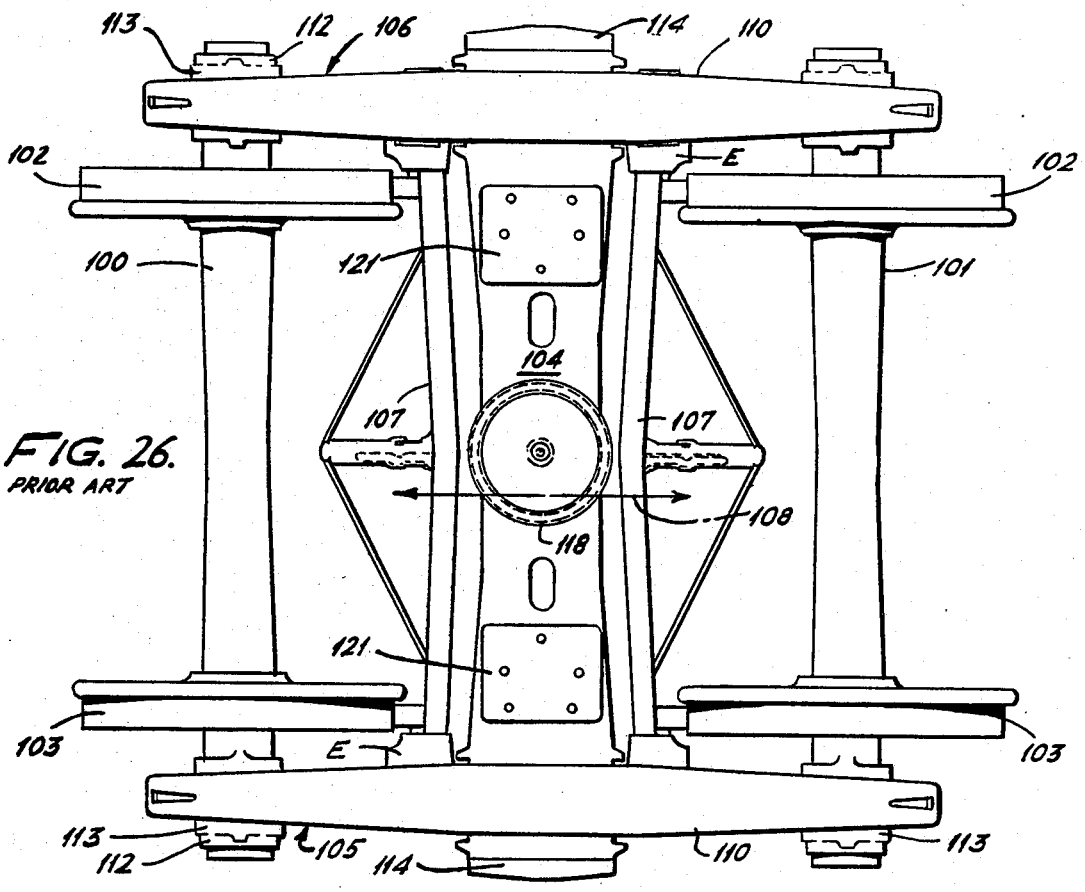
FIG. 26. PRIOR ART
Figure 27:
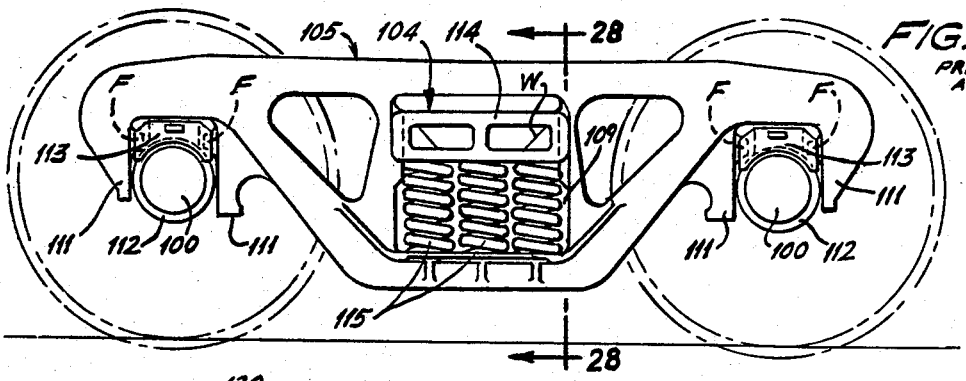
FIG. 27. PRIOR ART
Figure 28:
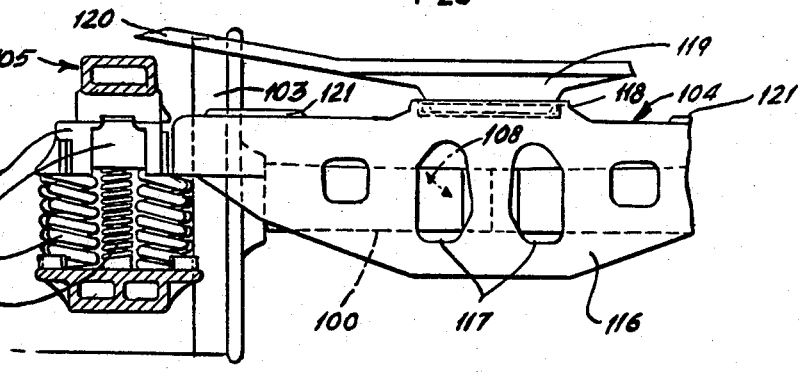
FIG. 28. PRIOR ART

FIGS. 26, 27 and 28 show the prior art truck prior to the retrofitting as shown for example in FIGS. 16 to 22;

First Embodiment Steering Action

Figure 5A:
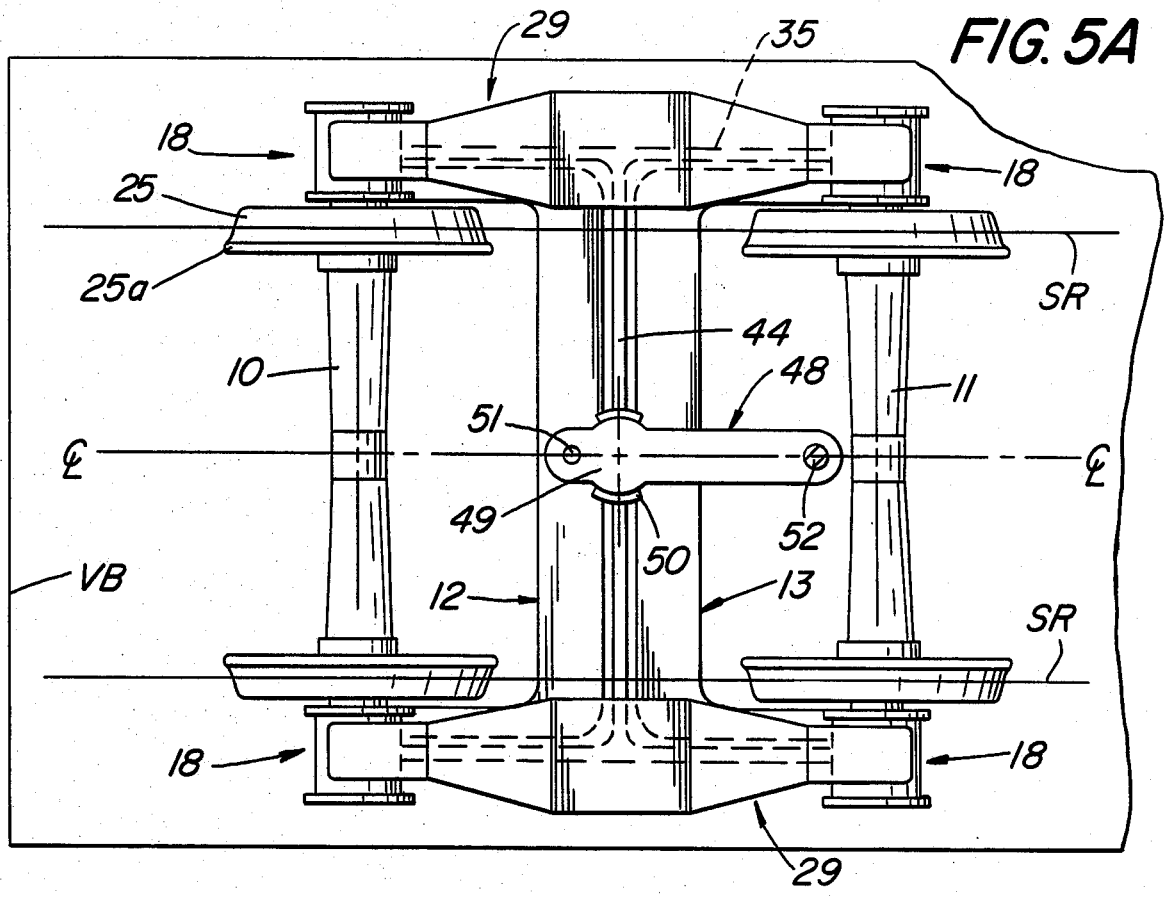
Figure 5B:
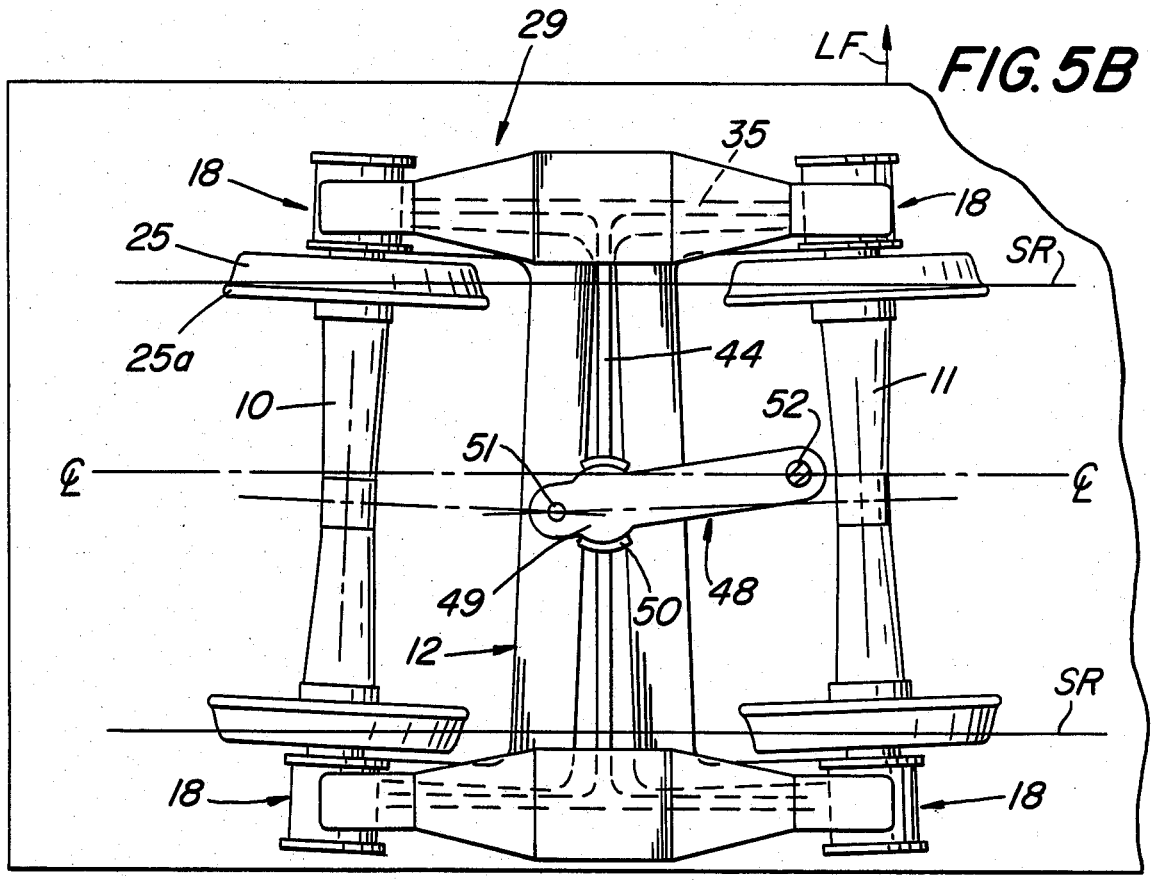
Figure 5C:
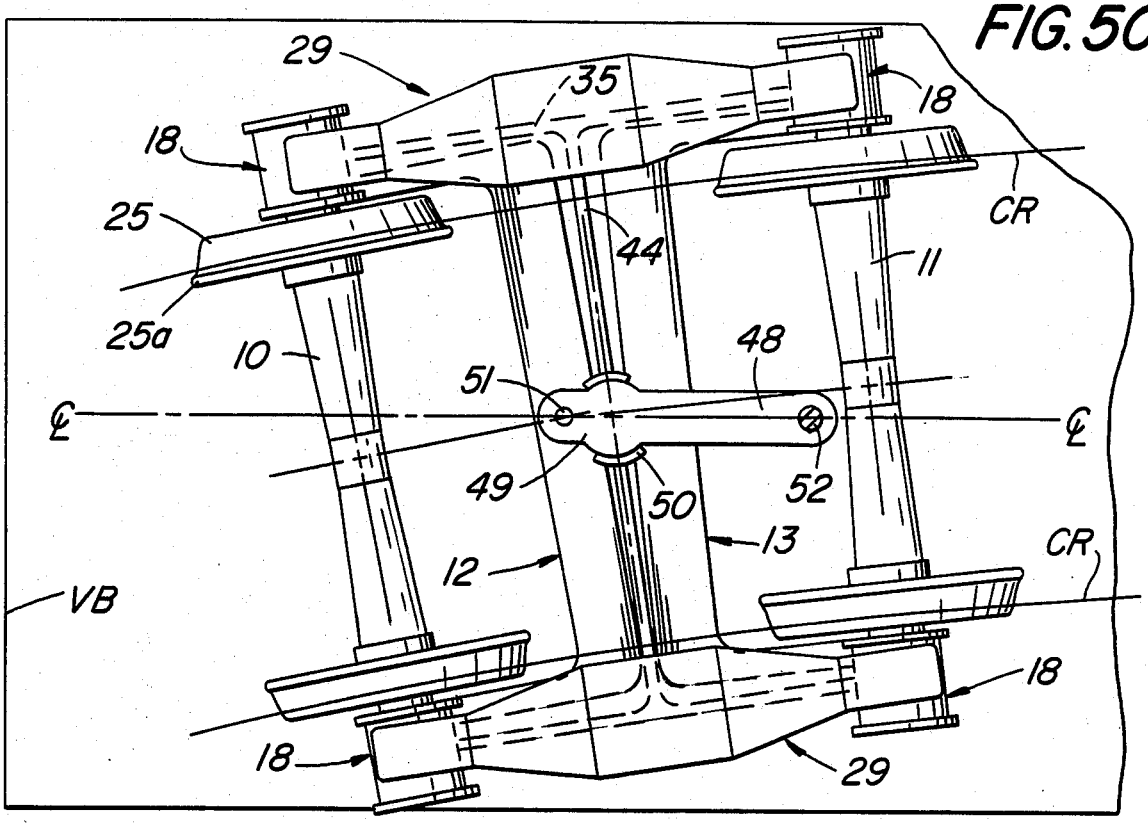
Figure 5D:
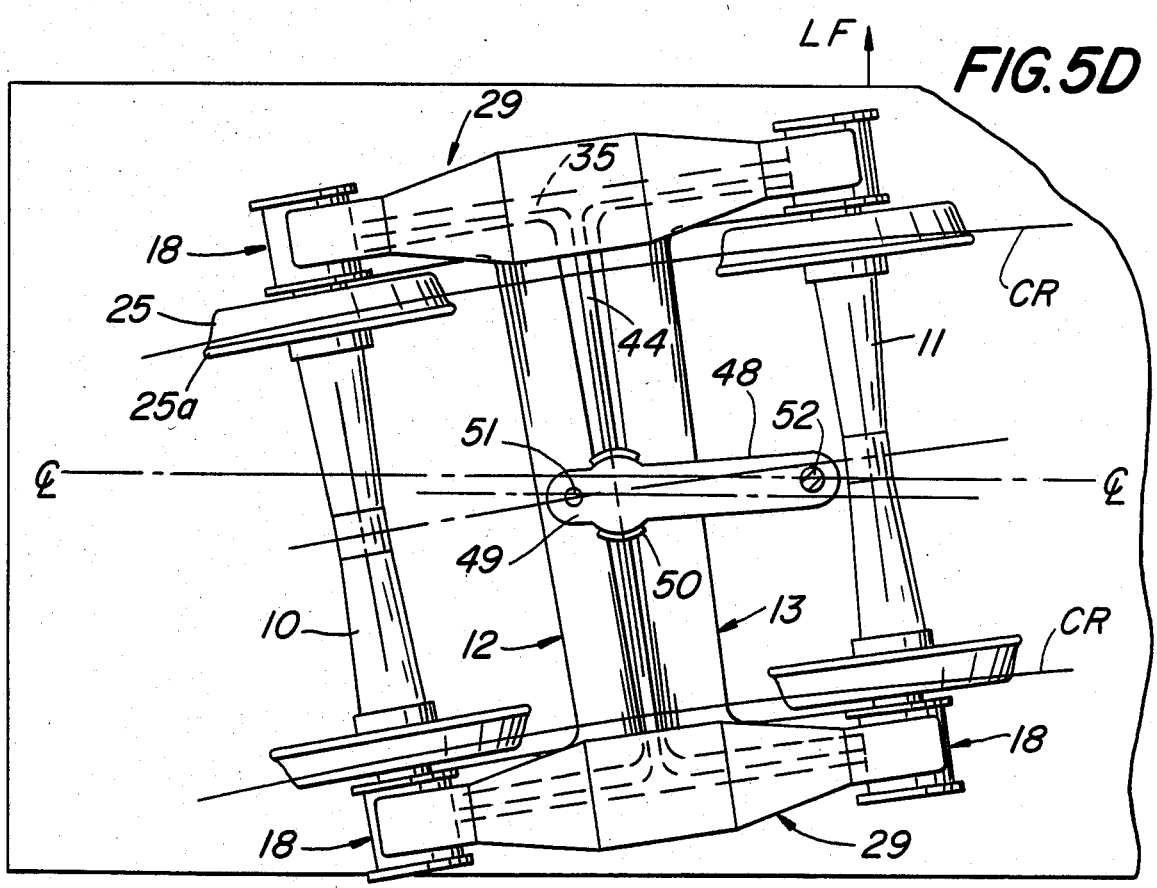
Figure 5E:
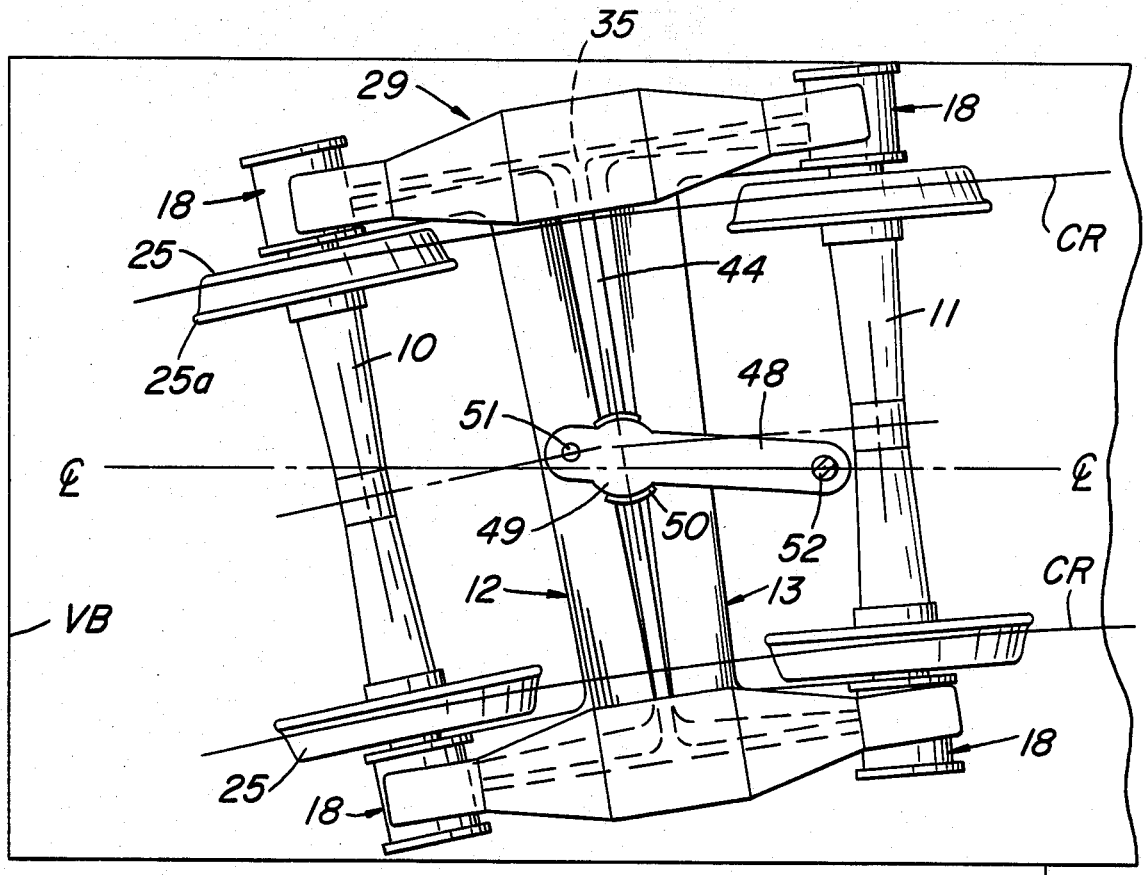

FIGS. 5A and 5B illustrate steering action of first embodiment on a straight rail path;

FIGS. 5C, 5D and 5E illustrate steering action of first embodiment on curved rail path;

Fifth Embodiment and Its Steering Action

Figure 29A:
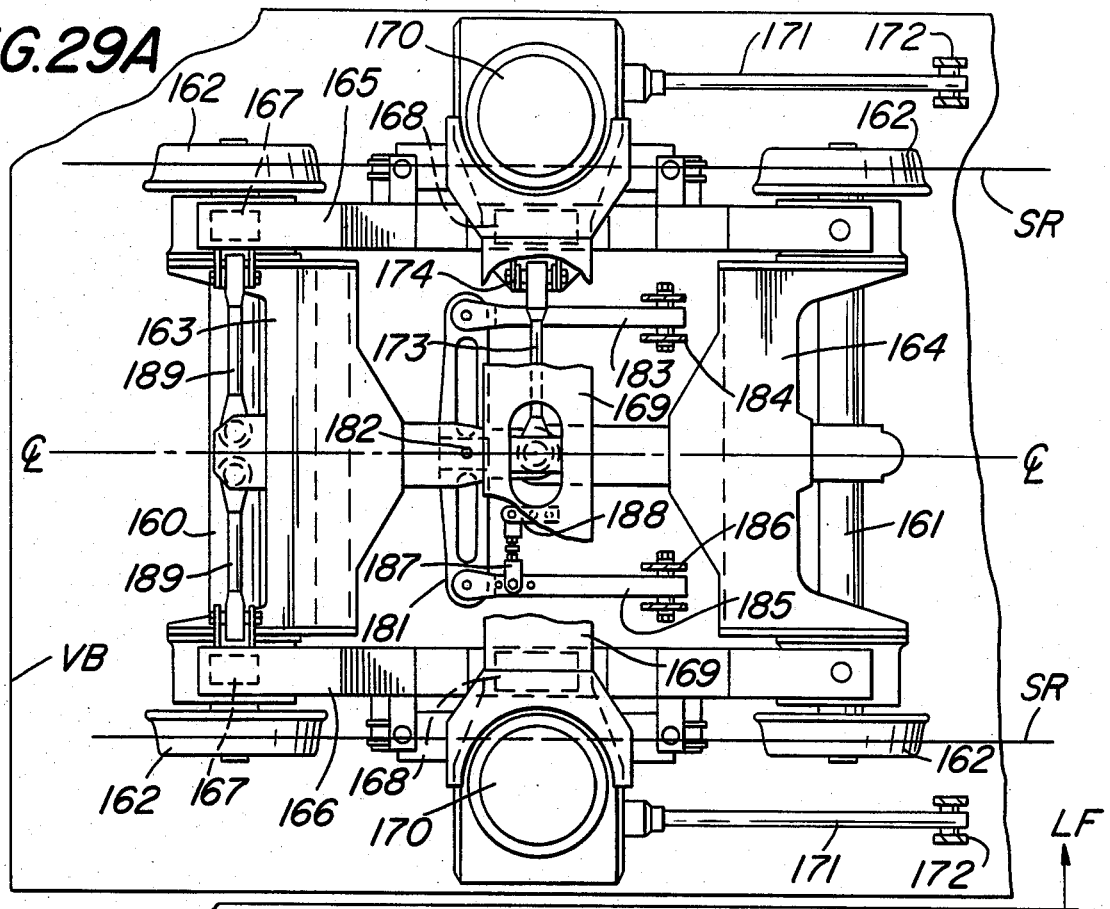
Figure 29B:
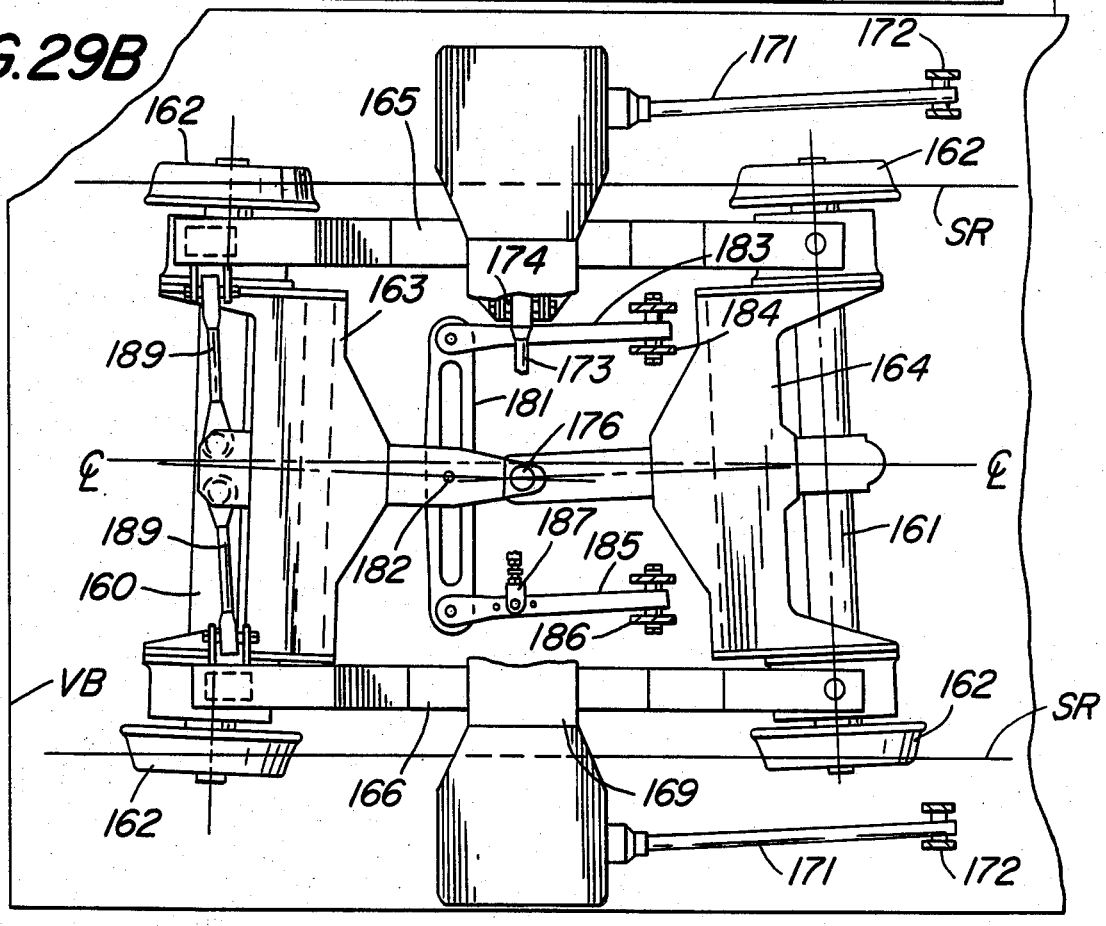
Figure 29C:
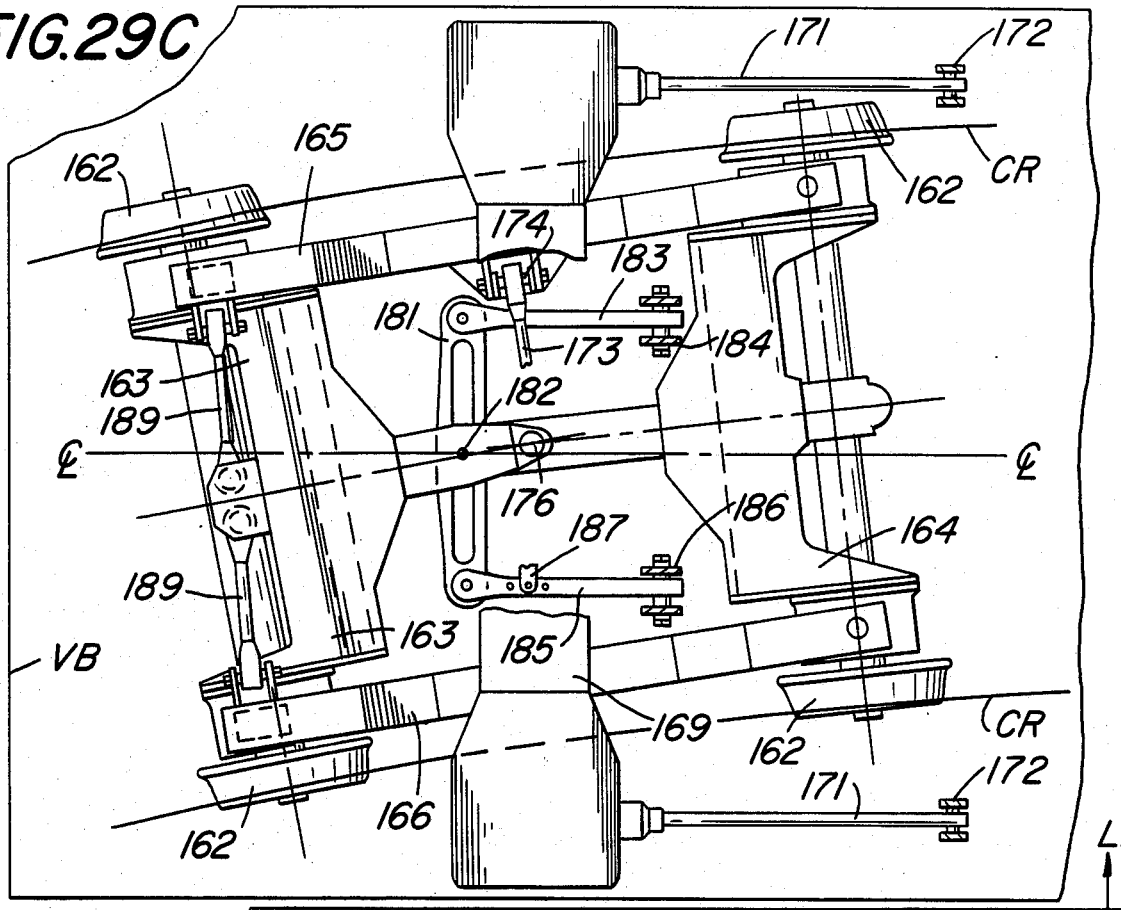
Figure 29D:
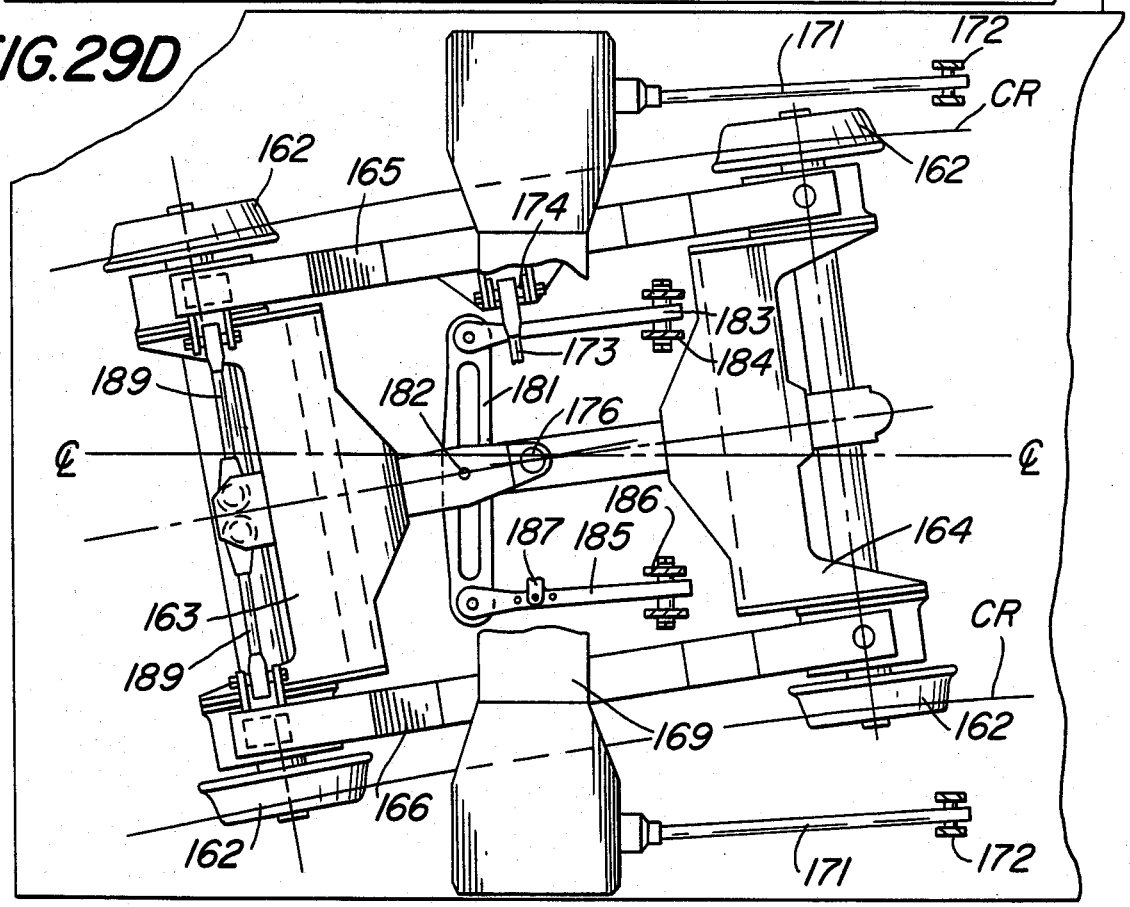
Figure 30:
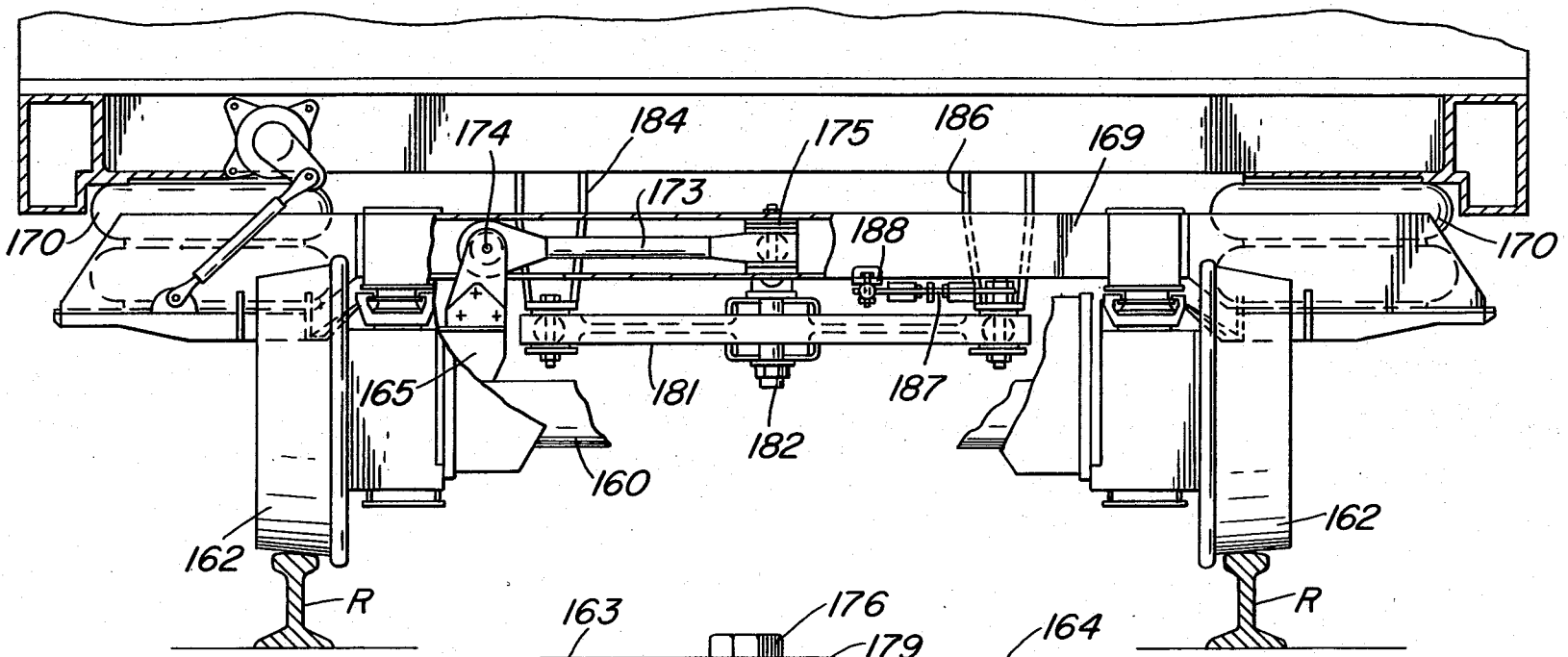
Figure 31:
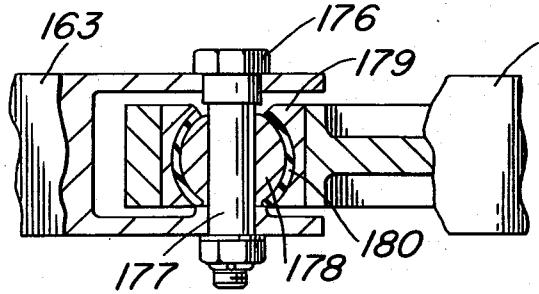

FIG. 29A is a plan view of the truck of the fifth embodiment, the truck here being shown in relation to a straight rail path;

FIG. 29B is a similar somewhat simplified plan view of the truck of FIG. 29A but illustrating a steering function on a straight track;

FIGS. 29C and 29D are views somewhat similar to FIGS. 29A and 29B but illustrating a steering function of the truck of FIGS. 29A and 29B on a curved rail path;

FIG. 30 is an enlarged end view of the truck of FIGS. 29A to 29D;

FIG. 31 is an enlarged detailed view of the joint between the steering arms.

Figure 32:
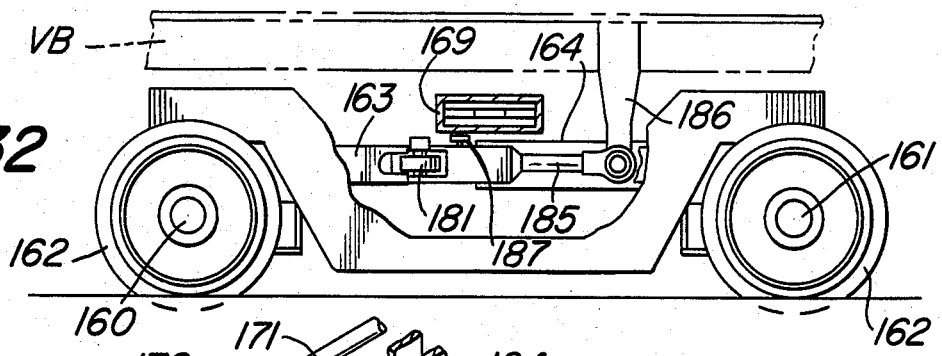
Figure 33:
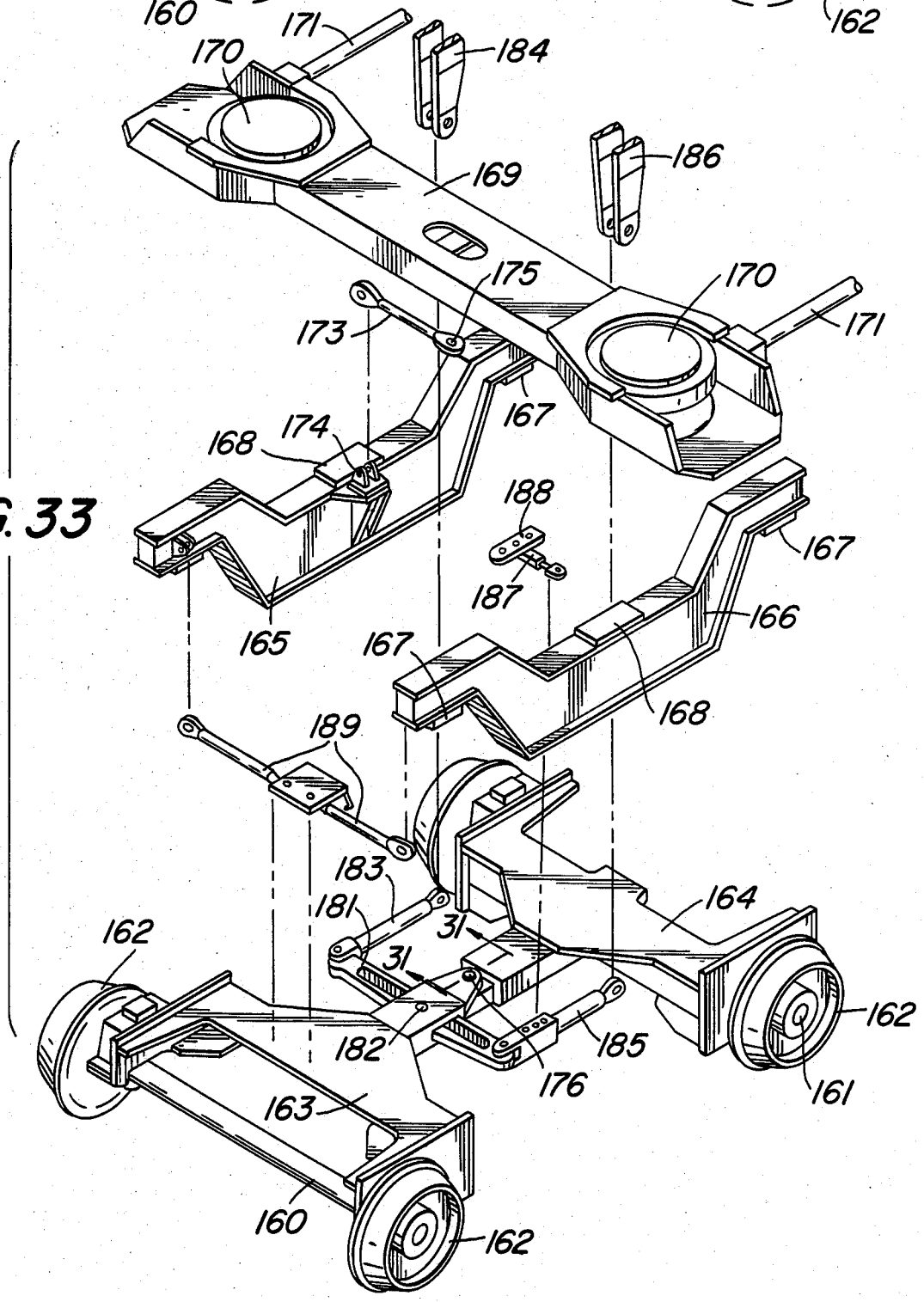

FIG. 32 is a side view of the truck of FIGS. 29A and 29D and 30, with parts of the truck side frame broken out;

FIG. 33 is a vertically exploded view of the principal parts of the truck of FIGS. 29A to 29D, and 30 and 31;

Sixth Embodiment

FIG. 34 is a plan view of certain control devices adapted for use with various forms of steering arms, such as those of the several embodiments referred to above;

FIG. 35 is a sectional of one of the control devices of FIG. 34; and

FIG. 36 is a force diagram illustrating the action of the devices shown in FIGS. 34 and 35.

DETAILED DESCRIPTION

Force and Motion Diagrams

Figure 2:
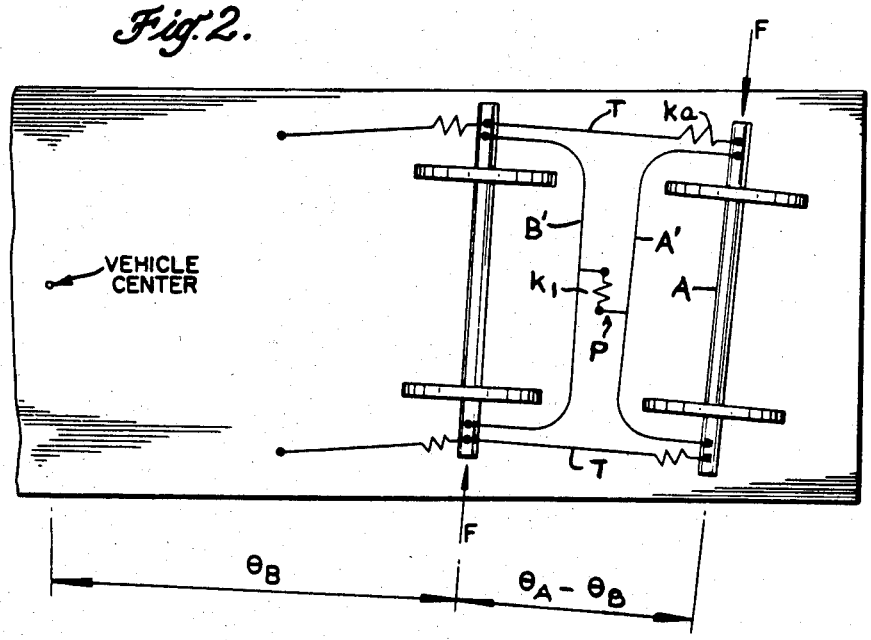
FIG. 2 shows schematically, and in basic terms, the response of such a truck to a curve.

The steering action of a four-wheel railroad car truck constructed according to the invention is illustrated somewhat schematically in FIGS. 1 and 2. The embodiment for use under the trailing end of a highway vehicle would be virtually identical, but, for simplicity, railroad truck terminology is used in the description.

The essential parameters are as follows:

The yaw (longitudinal) stiffness between the "inside" axle "B" and the truck side frames "T" is very high, i.e. a pinned connection.

The yaw stiffness between the "end" axle "A" and the truck side frames "T" is $k_a$.

The yaw stiffness between the truck side frames "T" and the vehicle is $k_e$.

The side frames "T" are essentially independent being free to align themselves over the bearings (not illustrated) of axles "A" and "B", even when there is substantial deflection in the longitudinal direction of the resilient member $k_a$.

Lateral forces between the two axles are exchanged at point "P", located in the mid-region between a pair of subtrucks, or steering arms, A' and B'. This interconnection has a lateral stiffness of $k_1$ and may also make a contribution to the yaw stiffness between the two axles. This connection provides for balancing of steering moments between the two axles, as well as providing the lateral stiffness.

The basic response of such a truck to a curve is shown in FIG. 2. The elastic restraints $k_a$ and $k_e$ have been deflected by lateral forces "F". The forces "F" can arise either from flange contact or from steering moments caused by creep forces between the wheels and the rails. Experimentally it has been observed that for relatively low values of $k_a$ and $k_e$, the axles will tend to assume a radial position in curves for a large range of variation of the ratio $k_a/k_e$. I have further discovered that for higher values, the proper value for this ratio must be chosen as a function of the truck wheelbase "w" and the distance s from axle "B" to the vehicle center. Thus a means is provided to have the high value for yaw stiffness needed for high speed stability while simultaneously providing radial positioning of the axles in sharp curves. The basic mathematical relationships which assure radial positioning of the axles are as follows:

For the axles to be in a radial position, their angular displacement will be proportioned to their distance from the center of the car body;

$$\theta_A - \theta_B = c \times w \text{ and } \theta_b = c \times s,$$

where c=the curvature per foot of length along the curve.

This gives the following ratio between the angles and the distances.

$$\frac{\theta_A - \theta_B}{\theta_B} = \frac{w}{s}$$

The angles are also dependent on the yaw stiffness.

$$\theta_A - \theta_B = \frac{F \times w/2}{k_a \times d} \text{ and } \theta_B = \frac{F \times w}{k_e \times d}$$

Substituting, we find that the relationship between the yaw stiffnesses and the distance should be:

$$k_e = k_a \times \frac{2w}{s}, \text{ or } \frac{k_a}{k_e} = \frac{s}{2w}.$$

Given the proportionality $$\frac{k_a}{k_e} = \frac{s}{2w}$$

it is a simple matter to translate the values for elastic restraint into suitable components. In the design and testing of one of the truck embodiments described below, the value for $k_a$ was selected to obtain stability against hunting up to a car speed of one hundred miles per hour. With this component established, use of the proportionality considered above readily yields the values to be embodied in the other elastomeric restraints, which are disposed between the car body and side frame ($k_e$).

In the case of rail vehicles where there is only a small clearance between the wheel flanges and the rail, the above ratio should be closely maintained. The action of the forces arising from the self-steering moments of the wheelsets will correct for some error, and the curving behavior will be superior to a conventional truck, even if it is not perfect.

In the case of highway vehicles, when a low value of $k_a$ is chosen, the rear bogie will tend to follow the front end of the vehicle rather precisely in a curve. As $k_a$ is increased, the trailing end of the vehicle will track inside the front end. If $k_a$ is made very stiff, the bogie will approach, but always be superior to, the tracking characteristics of a conventional bogie. As will be understood, given $k_a$, $k_e$ can be calculated.

Figure 3:
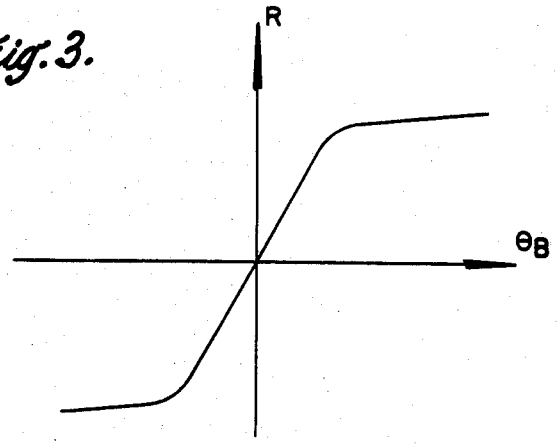
FIG. 3 shows a plot of the reaction of the flange force between the truck side frames and the vehicle, using modified restraining means and under conditions of very sharp curving, the reaction being plotted against the angle of track curvature.

While the apparatus shown schematically in FIGS. 1 and 2 will provide the desired major improvement in curving behavior and high speed stability on all ordinary railroad curves, there is also a need to limit the flange force "F" which occurs when operating occasionally on very sharp curves. This is most easily done by making $k_e$ a non-linear elastic restraint as shown in FIG. 3.

This restraint is comprised of a steep linear center section where $$k_e = k_a \times \frac{2w}{s}$$

and end sections where the value is much less. This will limit the reaction force "R" between the truck side frames and the vehicle, which will in turn limit the flange force "F".

For certain applications such as rail rapid transit vehicles where there is a need to obtain the lowest possible flange wear and operating noise on sharp curves, and at the same time obtain good high speed stability, it will be found desirable to add the feature shown in FIG. 4. The addition of steering link, or tow bar, "L" provides a means to keep the yaw stiffness high on straight track without contributing significantly to the flange force in curves. The presence of the restraints $k_t$ make it possible to choose low values for $k_a$ and $k_e$ without sacrificing yaw stiffness between the vehicle and the running-gear and within the running-gear.

The following parameters are dealt with in consideration of FIG. 4:

s=distance from vehicle center to closest axle;
w=truck wheelbase, axle-to-axle;
b=center line of subtruck (steering arm) associated with axle B;
a=center line of subtruck (steering arm) associated with axle A;
c=center line of truck framing;
O=center (pivot point) of truck framing;
P=point of interconnection of the subtrucks;
L=tow bar (steering link). In FIG. 4 it is shown offset from the vehicle centerline better to show $k_t$;
M=the point of interconnection between the tow bar and subtruck a;
x=the distance between the truck center O and the interconnection at M;
$k_t$=the lateral flexibility which limits the ability of the steering link to keep the lateral position of M the same as the lateral position of P; [When certain prototype trucks were operated in the FIG. 4 configuration, $k_t$ was the lateral stiffness of pads used to provide $k_a$ between the side frames and the subtrucks].
y=the distance between the connection of the steering link to the truck framing at M, and the point of connection of the link to the vehicle; and
f=the distance between the truck centerline and point M at the distance x from the truck center. This dimension is used in deriving the computation of the proper dimension for x.

The optimum values for x and $k_t$ must be found by experiment. However, it can be shown that x should be larger than a specific minimum at which the axles would assume a radial position if the restraints $k_t$ were infinitely rigid. This minimum value can be calculated using the equation $$x_{min} = \frac{w^2}{4(s+w)}.$$

This value is based on the fact that the angle between "b" (L to axle B, FIGS. 1 and 2) and the vehicle centerline, and the angle between "a" (L to axle A, FIGS. 1 and 2) and the vehicle centerline are proportional to the distances from the center of the vehicle (s and s+w). The lateral distance "f" in FIG. 4 can be calculated two ways, i.e.:

$$f = \frac{1}{r}(2s + w)\,x \text{ and;} \quad (1)$$

$$f = \frac{1}{r}\left(\frac{w}{2} - x\right) w \quad (2)$$

where 1/r is the track curvature. Equating these two expressions;

$$2sx + wx = \left(\frac{w}{2} - x\right) w$$

Solving for x gives;

$$x = \frac{w^2}{4(s+w)}.$$

The optimum value for $k_t$ will depend primarily on the total value for yaw stiffness required for high speed stability, the percentage of that value supplied by $k_a$ and $k_e$, and the percentage of that value contributed by the rotational stiffness of the connection at P. The value $k_t$ can be chosen to make up the remainder required.

There is also the question of choosing a proper value for y. This should in general be chosen as long as practical, if it is desired to minimize coupling between the lateral motion of the vehicle with respect to the running-gear and the steering motions of the axles. However, the length y has been made as short as two thirds w with success in prototypes, there being some indication in testing that a certain amount of coupling between lateral motion of the car body, with respect to the truck, and the steering action of the truck helps to stabilize lateral motions of the car body.

The principles disclosed above can be used directly to design running-gear having an even number of axles by grouping them in pairs. These principles have also been used to design a three-axle bogie, not shown.

The principles considered above have been applied in the design of a number of specific trucks, particularly railway freight trucks. As will now be understood, five truck embodiments are shown. One appears in FIGS. 5 to 12, another in FIGS. 13 to 15, the third in FIGS. 16 to 22, the fourth in FIGS. 23 to 25, and the fifth in FIGS. 29*a* to 32. The embodiments in FIGS. 16 to 22 and FIGS. 23 to 25 are suitable as "retrofit" arrangements and will be considered in comparison with the prior art, as illustrated in FIGS. 26 to 28.

FIRST EMBODIMENT

With detailed reference, initially, to FIGS. 7 and 8, from which parts have been omitted more clearly to show the manner in which each of two axles 10 and 11 is rigidly supported by its subframe (termed a "steering arm" in the following description), it will be seen that each axle is carried by its steering arm, 12 and 13, respectively, and that each axle has a substantially fixed angularity with respect to its steering arm, in the general plane of the pair of axles. The steering arms are generally C-shaped, as viewed in plan, (c.f. the steering arms A' and B' of FIGS. 1 and 2), and each has a portion extending from its associated axle to a common region (12*a*, 13*a*) substantially midway between the two axles. Means bearing the general designation 14, to which more detailed reference is made below, couples the steering arms 12 and 13 with freedom for relative pivotal movement and with predetermined stiffness against lateral motion in the general direction of axle extension. In this embodiment the stiffness against lateral motion, in the direction of axle extension and in the plane of the axles (it corresponds to the resilient means $K_1$ shown diagrammatically at P in FIG. 1), takes the form of a tubular block 15 of any suitable elastomeric material, e.g. rubber. It is suitably bonded to a ferrule, or bushing 16 (see particularly FIGS. 11 and 12), which is provided as an extension of steering arm 13, and to a bolt 17 which couples the steering arms, as is evident. This block or pad 15, through which the steering moments are exchanged, has considerable lateral stiffness. The resilience is sufficient so that each axle is free to assume a position radial of a curved track, and sufficient to allow a slight parallel yaw motion of the axles. This acts to prevent flange contact on straight track when there are lateral loads such as strong cross winds.

Turning now to the manner in which each axle is carried by its associated arm, it is seen that each steering arm carries, at each of its free ends, journal box structure 18 integral with the arm (see for example arm 12 in FIGS. 7 and 8). The box shape can readily be seen from the figures and opens downwardly to receive bearing adapter structure 19, of known type, which locates the bearing cartridge 20. Both ends of both axles 10 and 11 are mounted in this fashion, which does not require more detailed description herein. Retaining bolts 21 prevent the bearing 20 from falling out of the adapter 19 when the car truck is lifted by the truck framing.

Each journal box 18 has spaced flanges 22,22 which have portions extending upwardly and laterally of the journal box. These flanges define a pedestal opening which serves as retaining means for the car side frames, and also for novel pads interposed between the journal boxes and the side frames, as will presently be described. However, before proceeding with that description, and still with reference to FIGS. 7 and 8, it will be noted that each steering arm 12 and 13 carries a novel brake and brake beam assembly. These assemblies are designated, generally, at 23 (FIG. 8) and each includes a braced brake beam 24, extending transversely between the wheels (e.g. the wheels 25,25 carried by axle 10), and each end of each beam carries a brake shoe 26 which is aligned with and disposed for contact with the confronting tread of the wheel. The mounting of the brake assemblies is characteristic of this invention—in which each axle is fixed as against swinging movements with respect to its associated steering arm—and has significant advantages considered later in this description. For present purposes it is sufficient to point out that the brake beams 24 are prevented from moving laterally toward and away from the flanges 25*a* of the wheels, and for this purpose the opposite end portions of the beams are carried by rod-like hangers 27, each of which extends through and is secured in a sloped pad 28 provided in corner portions of each steering arm 12 and 13 (see particularly FIG. 8).

In particular accordance with my invention, and with reference to FIGS. 5 and 6, reference is now made to the manner in which the truck side frames 29,29 are carried by the steering arms, being supported upon elastomeric means which flexibly restrains conjoint yawing motions of the coupled pair of wheelsets, that is provides restraint of the steering motions of the axles with respect to each other, and thus opposes departure of the subtrucks (the steering arms and their axles) from a position in which the wheelsets are parallel. As will now be understood from FIGS. 2 and 3, described above, this restraining means ($k_a$ in those figures) may be provided only at the ends of that axle which is more remote from the center of the vehicle. However, it is frequently desirable to provide such restraint at the ends of each axle. Accordingly, FIGS. 5 and 8 show restraint at each axle; it can be of different value at each, depending upon the particular truck design.

As shown in FIGS. 5 to 8, the restraining means takes the form of elastomeric pads 30, preferably of rubber, supported upon the journal box, between the flanges 22, and interposed between the upwardly presented, flat, surface 18*a* of each journal box 18 and the confronting lower surface 31 (FIG. 10) of the I-beam structure which comprises the outboard end portions 32 of each side frame 29. As indicated in FIGS. 7 and 8, and as shown to best advantage in FIG. 10, the pads 30 are sandwiched between thin steel plates 30*a*,30*a*, the upper of which carries a dowel 33 and the lower of which is provided with a pair of dowels 34. The upper and lower dowels are received within suitable apertures provided, respectively, within the surface 31 of side frame end portion 32, and the confronting surface 18*a* of journal box 18. The purpose of the dowels is to locate the elastomeric pads 30 with respect to the journal box, and to position the side frame with respect to the pad 30. The side frame is thus supported upon the pads and between the flanges 22.

As shown in FIG. 6, each side frame 29 has a center portion which is lower (when viewed in side elevation) than its end portions 32. This center portion includes part of a web 35 having a top, laterally extending, flange 36 which is narrower at its outer extremities (FIG. 5) which overlie the journal box 18, and provides the bearing surface 31 (FIG. 10). The flange 36 reaches its maximum width in a flat central section 37 which comprises a seat for supporting an elastomeric spring member 38. This member has the form, prior to imposition of the load, of a rubber sphere. Member 38, although not so shown in the drawings, may if desired be sandwiched between steel wear plates. Desirably, and as shown, means is provided for locating the member 38 with respect to the seat 37 of the side frame, and with respect to the overlying car bolster 39 (FIGS. 6 and 9), which, with sill 40, spans the width of the car and is secured thereto. The car is illustrated fragmentarily at 41, in FIG. 6. This locating means, as shown in FIGS. 5, 6 and 9, may conveniently take the form of lugs 42 integral with the support surface 37 and the confronting lower surface of car bolster 39. A bearing pad 43, which may be of Teflon, or the like, is interposed between the upper surface of car bolster 39 and the overlying car sill structure 40 (FIGS. 6 and 9). This forms a sliding bearing surface, which operates to place a limit on flange forces which might otherwise become excessive in very sharp curves.

As will now be understood, the resilience of the elastomeric sphere-like members 38 provides the restraint identified as $k_e$ in the description with reference to FIGS. 1 and 2. As stated, its value is determined in accordance with the proportionality $$\frac{k_a}{k_e} = \frac{s}{2w}.$$

In one embodiment of the invention, which yielded good results, sphere-like springs marketed by Lord Corporation, of Erie, Pa. and identified by part number J-13597-1, were found suitable for applicant's special purposes described above.

The truck shown in FIGS. 5–8 can be made to function as does the truck of FIGS. 1 and 2 by either omitting pads 30' at axle 11, or by making these pads substantially stiffer than pads 30 at axle 10. The benefit achieved by doing this is that the steering effect of a linkage L, such as shown in FIG. 4, is obtained merely by the proper distribution of the stiffness of pads at the axles.

A support, or cross-tie, 44 extends between the webs 35 of the side frames 29, in the central portion of the latter (FIGS. 5 and 6), and has its ends fastened to the side frame web as shown at 45 in FIG. 9. The cross-tie is a relatively thin plate with its height extending vertically, and its center portion has an aperture 46 through which passes the means 14 which couples the mid-portions of the two steering arms 12 and 13. The aperture 46 is of larger diameter than the coupling means 14. As shown in FIG. 9, and as also appears in FIG. 6, it is important for the purposes of the invention that there be freedom for limited tilting of one side frame with respect to the other, in the general plane containing the axles 10 and 11. (See also the flexible side frames T of the apparatus shown schematically in FIGS. 1 and 2.) In the present embodiment this freedom is ensured by limiting the thickness of the cross-tie 44 to a value such as to permit the required flexibility between side frames, and by the freedom for relative movement between means 14 and cross-tie 44, afforded by the clearance of the cross-tie in the aperture.

A pair of strut-like dampers 47,47 interconnect the side frames and the car bolster 39. While these dampers have been omitted from FIGS. 5 and 6, in the interest of clarity of illustration, they show to good advantage in FIG. 9. Their purpose is to damp vertical and horizontal excursion of the car body and, importantly, they are inclined inwardly and upwardly to minimize the effect of vertical track surface irregularities on lateral motion of the car body.

In certain embodiments of the present invention it has been found very advantageous to provide linkage or a link such as a tow bar which interconnects one steering arm with the body of the car or other vehicle. The tow bar comprises the steering link L, in the diagrammatic representation of FIG. 4, and it appears at 48 in FIGS. 5, 6 and 9. Its disposition and point of securement to the car body are unique to this invention as has already been explained with reference to FIG. 4.

As best shown in FIGS. 5 and 9, the tow bar 48 has an arcuately formed portion 49 intermediate its ends and this portion 49 is journaled within and cooperates with spaced, confronting arcuate flanges 50,50, carried by the central part of the upper edge of the tie-bar 44. This cooperation provides for swinging movements of the tow bar about the center of its said arcuately formed portion 49 and permits the side frame assembly to serve as a point of reaction for torque forces imposed by the connection of the ends of the tow bar to one of the steering arms and to the car body. As illustrated in FIGS. 5 and 6, the left end of the tow bar overlies the steering arm 12, which should be understood as being associated with that axle (10) which is the more remote from the center of the car body. This end is connected to steering arm 12 by pivot mechanism represented by the pin 51. The opposite end of the tow bar extends in the direction of the center of the car body, and its pin 52 is rotatably carried by a tow bar trunnion 53 secured to a portion 41*a* (FIG. 6) of the car sill structure 40, at a point lying along the longitudinal centerline of the car (FIG. 5).

In accordance with this invention, and as described above with reference to FIG. 5, the point of securement of the tow bar 48 to the more remote steering arm 12 is at a point 51 whose location is a function of the truck assembly's wheelbase w, and the distance s between the two truck assemblies, under a car body. The minimum value of the distance x, from the truck center 49 to the point 51, should satisfy the expression $$x_{min} = \frac{w^2}{4(s + w)}.$$

The primary function of the tow bar is to take care of longitudinal forces between the car body and the resiliently mounted wheelsets. Such forces arise, for example, from braking and coupling impacts. In conventional trucks, e.g. freight car trucks now in common use, where no tow bar is present, these forces associated with braking and coupling are passed through the bolster and side frames. In the apparatus of the present invention, these forces, particularly the forces caused by coupling impacts, would, if not properly dissipated, cause unacceptable deflections and wear in the elastomeric pads 30 which mount the steering arms to the side frames, and the side frames to the car body.

In addition to the function of the tow bar shown in FIGS. 5–12, as described just above, the tow bar of that embodiment further serves an important function as a link influencing the steering action of the truck as will now be described.

First Embodiment Steering Action

Although the steering action of the first embodiment (FIGS. 5 to 12) is briefly referred to hereinabove, the group of figures identified as FIGS. 5A, 5B, 5C, 5D and 5E, more fully illustrate the nature of the steering action of the first embodiment. In these figures the body of the vehicle is indicated at VB, the body centerline also being indicated. The longitudinal center of the body would be offset to the right of those figures.

FIGS. 5A and 5B show the influence on the steering action where linkage such as indicated at 48 is employed, such linkage being associated with the steering arms or yokes and also with the body of the vehicle and the truck framing. In FIGS. 5A and 5B, the truck is shown as travelling upon a portion of a rail path which is straight, lines representing the parallel straight rails being indicated in FIGS. 5A and 5B at SR.

In FIG. 5A, it will be seen that the two axles 10 and 11 of the truck there shown are positioned in parallel relation and perpendicular to the rails SR. This view also shows the longitudinal center line of the vehicle body VB as coinciding with the longitudinal center line of the truck. In FIG. 5A, the point of connection 51 of the linkage 48 with the steering arm 12, is also located on the center line. Moreover, the point of connection 52 of the linkage 48 with the body of the vehicle VB is also on the center line. The center point of the arcuate surfaces, 50—50 and the arcuate part 49 of the linkage 48 is positioned on the center line. Under stable conditions of operation of the truck upon a straight track, the positions of the parts would conform with those described above.

Turning now to FIG. 5B, and assuming that in the travel of the truck, for instance, at high speed on the straight track shown in FIGS. 5A and 5B, some force arises, for instance a transient lateral track displacement tending to unbalance the steady or stable travel of the vehicle. This force may include fluctuating lateral forces arising from motion of the body of the vehicle VB laterally, for instance in the direction indicated by the arrow LF shown in FIG. 5B. This lateral shifting of the vehicle body will carry with it one end 52 of the linkage 48, with consequent shifting in position of the pivot 51 with the steering arm 12 in the opposite lateral direction, which is the position illustrated in FIG. 5B. Because of the mounting of the central arcuate portion 49 of linkage 48 between the arcuate surfaces 50—50 which are connected with the truck side frames through the cross-tie 44, the interconnection between the two steering arms 12 and 13 would then be caused to shift with respect to the truck framing in the direction toward the lower side of FIG. 5B, with consequent shift in the angular position of the associated wheelsets. Thus, the axles of the wheelsets would shift away from parallelism, with the angle between the axles widened at the lower side of FIG. 5B, as is indicated in that figure.

The result of this activity is to introduce a stabilizing steering force tending to damp out the lateral motion of the car body, improving the overall vehicle stability when travelling at high speed on a straight track. Instabilities are thus automatically corrected or diminished.

In connection with the above activity it is pointed out that the conicity of the wheels as conventionally employed, is known to be the basic cause for hunting and instability on straight track and on gradual curves. It is of great importance to note that the steering action provided by interconnection of the steering arms arranged in accordance with the present invention, together with the novel linkage interconnecting one of the steering arms with the body of the vehicle, acts to reduce the effect of the wheelset conicity, thereby diminishing lateral hunting motions on straight track.

FIGS. 5C and 5D are figures similar to FIGS. 5A and 5B respectively, but FIGS. 5C and 5D illustrate the compound effect of the interconnected steering arms and the use of the linkage between the steering arms and the body of the vehicle, when travelling on curved track. As pointed out above, in FIGS. 5A and 5B the truck parts are shown in the activity as occurs when travelling on straight or tangent track, the straight rails being shown in FIGS. 5A and 5B at SR. On the other hand, in FIGS. 5C and 5D curved rails of a curved trackway are indicated at CR.

Turning now specifically to the illustration in FIG. 5C, the position of the parts, notably the wheelsets and steering arms is that which the parts would assume under the steering action occurring on gradually curved track as a result of the interconnection of the wheelsets through the respective steering arms and the steering arm interconnecting joint 14 described above in connection with FIGS. 5 to 12. Note also that in this condition, the wheels at the outer side of the curve are riding on the rails along a path in which the diameter of the conical tread is somewhat greater than the position of the straight track rails in FIG. 5A, but the flanges of the outer wheels are not in contact with the outer rail. In FIG. 5C the linkage 48 is still centered with respect to the centerline of the vehicle body VB. The pivot 52 connecting the link 48 with the vehicle body, and the pivot 51 connecting the link 48 with the steering arm 12, and also the joint 49–50 are all located along the centerline of the vehicle body. FIG. 5C thus illustrates the position of the truck parts under the self-steering action without the introduction of any lateral motion of the vehicle body with respect to the trackway. This is the condition present when the car is travelling on a curved track at the Balance Speed, i.e. when the increased elevation of the outer rail is exactly correct for the combination of the speed and curvature.

In this position of the parts in FIG. 5C it will be seen that the wheelsets have assumed substantially radial positions with respect to the curvature of the curved track CR. This, of course, is an important and desired steering function achieved by the interconnected steering arms. The resilient pads 30 (not shown in FIGS. 5A to 5D but illustrated in FIGS. 5 to 10) facilitate this self-steering function as is already explained hereinabove.

As frequently occurs in travel on curved trackway, forces are introduced, particularly at speeds well above the Balance Speed, tending to shift the position of the vehicle body laterally outwardly, and such a lateral shift of the vehicle body is indicated by the arrow LF applied to the vehicle body VB in FIG. 5D. Travel at a high speed well above the Balance Speed will also tend to bring the flanges of the outer wheels against the outer rail. With the interconnection of the steering arm with the linkage shown in FIG. 5D, this lateral motion of the vehicle body will carry with it the pivot point 52 of the linkage 48, with consequent opposite motion of the pivot 51 which interconnects the link 48 and the steering arm 12. This lateral vehicle body motion therefore introduces a steering force into the system of interconnected steering arms for the two wheelsets and, as will be seen from FIG. 5D, the angle between the wheelsets is diminished. In other words, when the vehicle is operated above the Balance Speed the lateral motion of the vehicle body has diminished the steering effect which the self-steering action of the interconnected steering arms tends to establish on curved trackway. It is essential that the steering respond in this manner so that high speed stability on straight track and gradual curves is enhanced.

It will thus be seen that the link 48 not only serves the tow bar function hereinabove described, but also serves to introduce a desirable balance of forces during high speed travel on straight or gradually curved track and also during travel above the Balance Speed of the vehicle on more sharply curved track.

Attention is now directed to the conditions represented in FIG. 5E. Here the truck is travelling on the curved rails CR, as in FIGS. 5C and 5D, but the conditions represented in FIG. 5E correspond to those encountered at times when the truck is travelling well below the Balance Speed on the curved track. In this condition the flanges will have a tendency to move away from the outer rail and may engage the inner rail, especially when the outer rail is positioned at an elevation substantially above the inner rail. It is well known that flange climbing, especially under conditions when the outer wheels have a reduced vertical loading, is a common source of derailment.

However with the arrangement as shown in FIG. 5E, this low speed condition of travel on the curved track, especially where the outer rail lies substantially above the inner rail, results in a lateral force LF on the body tending to shift the body of the vehicle radially inwardly of the curved trackway. This movement of the body will react through the linkage 48 in a manner tending to increase the steering action effected by the interconnected steering arms, and this in turn automatically steers the wheel flanges of the outer wheels away from the outer rail of the curve. This will eliminate a common cause of derailment.

Similar desirable actions are obtained with other forms of the equipment herein disclosed embodying both interconnected steering arms for the wheelsets and also linkage interconnecting the steering arms with the vehicle body or with some component or structure participating in lateral motion of the vehicle body. As will be shown hereinafter, the compound action of the coordinated steering motions of the wheelsets and the motions introduced from lateral motion of the vehicle body may be achieved not only by the use of a single tow bar type of linkage, but also by other forms of linkage including a multiple linkage, as described hereinafter with particular reference to FIGS. 29A to 29D inclusive.

Second Embodiment

Reference is now made to a modified form of railway truck embodying the invention, and illustrated in FIGS. 13, 14 and 15. In this somewhat simpler apparatus a cross bolster is embodied in the truck, and imposes the weight of the car upon the side frames. Additionally this truck bolster is flexibly associated with the two side frames and serves as the only interconnection between the two.

In terms of basic structure for supporting the axle-borne wheelsets, and for providing resilient damping at the axle end portions, and also between the truck and the car body, the apparatus is in many respects similar to the embodiments already described. Accordingly, like parts bear like designations, with the subscript b. Thus, axles **10*b* and 11*b* are, respectively, carried by generally C-shaped steering arms 12*b* and 13*b*, and each steering arm, as was the case in the preceding embodiment, has a portion extending from its associated axle, with respect to which it has a substantially fixed angularity, to a common region substantially midway between the two axles. Means 14*b* couples the steering arms with freedom for relative pivotal movement, and with predetermined substantial stiffness against lateral motion in the general direction of axle extension. In this embodiment, the coupling means 14*b* (see FIG. 15) comprises a pair of studs 55 and 56, each of which extends from an associated one of the steering arms toward the zone of coupling. The stud 55, carried by arm 12*b*, is recessed as shown at 57, while stud 56 has a reduced, hollow end portion 58 which extends within the recess. Elastomeric material 59, preferably rubber, is interposed between extension 58 and the interior wall defining the recess 57, and is bonded to the adjoining surfaces. A bolt 60 serves to retain the parts in assembly. Again, as was the case with the preceding embodiment, the coupling 14*b***, through which the steering moments are exchanged, has considerable lateral stiffness and an angular flexibility sufficient so that each axle is free to assume a position radial of a curved track and free to adjust to track surface irregularities.

As shown in the cross-sectional portions of FIG. 13, which is taken as indicated by the line 13—13 applied to FIG. 14, it will be seen that each steering arm has journal box structure 61, at each end thereof, and in this case flanging, shown at 62, projects from the journal box structure in the direction of the length of the truck. The journal box has an upper substantially flat surface 63 upon which is seated an elastomeric pad 64. These pads may be sandwiched in steel and, if desired, mounted upon the surface 63 in the manner already described with respect to FIGS. 5–8. The axles **10*b* and 11*b* are supported by structure which is of the character already described with respect to the earlier embodiment, and which fits within the downwardly facing pedestal opening provided by jaws 68. In practice, means (not shown) would be provided to retain the axle and the bearing adapter structure within the pedestal opening. Brakes have also not been illustrated, since in this embodiment, they would either be conventional or be of the kind already described with respect to FIGS. 5, 6 and 9**.

In accordance with my invention, the truck side frames 65,65 are carried upon the bearing portions of the steering arms and, importantly, are supported upon the pads 64, as appears to good advantage in FIG. 14.

Such pads have been shown at each end of each axle, although it will now be understood that they may be used at the ends of one axle only, or that pads providing different degrees of flexible restraint may be used with each axle. These pads, as will now be understood, restrain the steering motions of the axles with respect to each other and oppose departure of the subtrucks, which are comprised of the wheelsets and steering arms, from a position in which the wheelsets are parallel. Each side frame comprises a vertically extending web portion 66 having horizontal flanging 67 (FIG. 13) extending laterally from each side of the web. The flanging tapers from a substantial width in the central region, between the two steering arms, to a relatively narrow width where the arm overlies the pads 64. Each side frame has a pedestal opening between pedestal jaws 68 (FIG. 14) which straddles the journal box assembly and is restrained thereon by cooperation with the interior surfaces 69 of flanges 62, in the manner shown in FIG. 13. Each side frame 65 is provided with a generally rectangular aperture 70 (FIG. 14), the upper portion of which accommodates the end portions 72 of a truck bolster 71, and provides a seating surface for the springs 73 (in this case six are provided), which react between the side frame 65, at 74 as shown in FIG. 14, and the undersurface of the projecting end 72 of the truck bolster 71.

The bolster extends laterally of the width of the truck and provides articulated connection means between the two side frames. In this instance no tie-bar is used. The bolster ends, since they pass freely through upper portions of the side frame apertures 70, flexibly interconnect the side frames with the freedom for relative tilting movements which is characteristic of this invention. In a center part of the bolster, overlying the means **14*b* which couples the steering arms, and which does not contact the bolster 71 (see FIG. 14), there is a bowl-type receiver 75, for the car body center plate which, as will be understood by those skilled in this art, is fastened to the car's center sill, which is not illustrated. As is clear from the foregoing description, in the apparatus of this invention the coupler means (P in FIG. 1, 14 in FIGS. 5 to 9, 14*b* in FIGS. 13 to 15, and described hereinafter with reference to other embodiments), is free for steering motions in a direction across or transversely of the truck. Thus, it is also true that lateral motion of truck parts, such as the truck bolster illustrated in FIG. 14, may occur independently of the motion of coupler means 14*b***.

To provide the resilient restraint identified as $k_e$, in the description with reference to FIGS. 1 and 2, that is the restraint between the truck and the car body, the embodiment of FIGS. 13, 14 and 15 has a pair of elastomeric pads 76,76 carried, at spaced portions of the upper surface of truck bolster 71, being held there in any desired manner, and are cooperable with the car bolster (not shown) which forms part of the sill structure. The function of these pads will be understood without further description. It should also be understood that a less suitable, but in some cases adequate, yaw restraint of the truck bolster can be provided by a conventional center plate and side bearing arrangement.

Prior Art AAR Truck

In considering the third and fourth structural embodiments of the invention illustrated in FIGS. 16 through 25, it should be emphasized that in these figures the invention is shown as applied by retrofitting the well-known AAR truck, which, per se, is shown in FIGS. 26–28 labelled "Prior Art".

This known truck will first be described with reference to FIGS. 26–28. It comprises a pair of wheelsets including axles 100 and 101 each having fixedly mounted thereon a pair of flanged wheels 102 and 103. Like the apparatus shown in FIGS. 13–15, a cross bolster 104 is embodied in the truck, and imposes the weight of the car upon a pair of spaced side frames 105 and 106. The bolster in such a known truck is flexibly associated with the two side frames; and with the exception of the brake beams 107, serves as the only interconnection between the two frames. The brake beams do not, of course, serve as structural members between the side frames since their ends are loosely received within support fittings E carried by the side frames.

In certain of the standard trucks, a part (throughrod) of the brake rigging here indicated purely diagrammatically at 108 extends through one of the apertures 117 fore and aft of the bolster.

As appears in FIG. 27, the truck side frames have considerable depth in their mid-region. They are defined by a vertically extending web which has a large, generally rectangular aperture 109 and an upper, generally horizontal web or surface 110 (FIG. 26), extending laterally to each side of the central portion of the side frame and terminating in downwardly opening pedestal jaws 111 which straddle the axle journal bearing assembly 112. The latter, in conjunction with bearing adapters 113, serves to mount the wheelsets in known manner. The bearing adapters are of known type, also useable with minor modification in the retrofitted structure presently to be described. As will then be shown and described in detail, such adapters have slots, or keyways, within which are received flanges F (FIG. 27) which serve to position the adapter, and its bearing 112, with respect to the pedestal jaws 111.

Extending between the confronting apertures 109 of the two side frame members is the mentioned bolster 104. Its outboard ends 114 are of considerable width and limited height. The width is such that said outboard ends substantially span the width of the apertures 109, and each such bolster end extends through a corresponding aperture (one appears in FIG. 27) to a position in which it projects beyond its associated side frame (105, as illustrated in FIG. 26). The height of each outboard end is such that the springs 115, which are seated upon the lower wall structure which defines aperture 109, lie beneath the outboard bolster portion 114 and support the same with freedom for some vertical travel under the imposed load.

The bolster 104 is of considerable depth in the mid-region between the side frames (see FIG. 28), and the above-described association of its ends 114 with the side frames interconnects the side frames with limited freedom for relative movements. This bolster mid-region of considerable depth appears at 116 in FIG. 28, which figure also shows that this region of the bolster is provided with several apertures 117, sized and positioned to accept the "rod-through" brake rigging which is conventionally used in such prior art trucks, i.e., the rigging parts above referred to and diagrammatically indicated at 108. In the center of the upper surface of the bolster is the bowl-type receiver 118 which supports the center plate 119 of the car body, shown fragmentarily at 120 (FIG. 28). Reinforced pad means 121,121 are spaced across the upper surface of the bolster, and are provided to receive side bearing rollers (not shown)

which contact a surface (not shown) carried by the body bolster normally provided on the understructure of the car. A wedge W, of common type, fits within the bolster end 114 (FIGS. 27 and 28), being urged upwardly by a spring 115*a*, which is smaller than the springs 115.

As noted above, it is such a truck which is now in common freight use on United States' railroads, and it is to be understood that in such trucks, notwithstanding liberal clearance in the fit of the bearing adapter in the pedestal jaws and between the bolster and side frames, the wheelsets are constrained to be generally parallel. Thus, both axles cannot assume a position radial to a curved track and the flanges of the wheels strike the rails at an angle. These trucks are, therefore, subject to all the difficulties and disadvantages fully considered earlier in this description. As noted, some efforts have been made to redesign such trucks in order to allow the axles to assume positions substantially radial of a curved track. However, such efforts have not, prior to this invention, attempted retrofitting to facilitate steering. In fact most such redesigned trucks have lacked stability at speed. Primarily, this has been because of the lack of recognition in the art of the importance of providing certain resilient, lateral restraints which I have found to be required to prevent high speed hunting, and which also serve to enhance curving.

Third Embodiment and Retrofitting

It is an important aspect of my invention that a known truck of the kind described above in reference to FIGS. 26, 27 and 28, may readily be retrofitted to incorporate resilient steering structures of this invention, which provide proper curving and the essential stability. As will be understood from the following description of FIGS. 16 to 22, it has been found possible to accomplish such retrofitting without requiring any modification of several major truck parts, such as wheelsets, bolster and side frames (as shown below, it may in certain embodiments be desirable to make minor changes in the pedestal area of the side frames), and, by the relatively simple addition to the truck of steering arms and resilient structure of the kind characteristic of this invention.

In accordance with one aspect of the invention, there is provided a method of retrofitting a railroad truck having constrained wheelsets with mechanism providing for coordinated steering of the wheelsets. This method, which is described just below, is practiced in the retrofitting of the AAR truck (FIGS. 26–28), to provide the trucks either of the Third Embodiment as shown in FIGS. 16–22 or the Fourth Embodiment as shown in FIGS. 23–25, the constructional features of each of which will be described later in this disclosure.

The retrofitting method is briefly described as follows:

An existing truck is selected having load-carrying side frames with opposed pairs of pedestal jaws, within which are received the usual axle bearings and bearing adapters, the latter having load-carrying connections with the side frames, and being movable with respect to the side frames independently of the other wheelset;

a generally C-shaped steering arm is applied to each wheelset;

connections are established between the adapters and free arm portions of the steering arms, with each adapter interpositioned between its corresponding bearing and pedestal jaw, to thereby provide for conjoint motion of each pair of adapters and its wheelset;

the steering arms are pivotally interconnected between the wheelsets, to exchange steering forces between the latter and to provide for coordinated pivotal steering motions of the two wheelsets; and yielding steering motion restraining means is introduced in load transmitting position between the bearing adapters and the base ends of the pedestal jaws.

When retrofitted in this manner, the truck is capable of smooth, quiet self-steering, while maintaining stability at speed, and has the physical characteristics shown, for example, in FIGS. 16–22, except that the brake equipment may be unmodified, if desired, and remain as shown in FIGS. 26–28.

Now with detailed reference to FIGS. 16–22, it should be noted that considerable structure shown in those figures also appears in FIGS. 26–28, discussed above, as will now be understood, and similar parts are, therefore, shown identified in FIGS. 16–22 with similar reference numerals. First with reference to FIGS. 16 and 17, it will be seen that the structure, after retrofitting, is provided with a pair of steering arms 122 and 123, (compare the steering arms 12 and 13 of the embodiment of FIG. 5 and the steering arms 12*b* and 13*b* in the embodiment of FIG. 13), through which the vehicle weight derived from the side frames is imposed upon the axle bearing assemblies, in the manner to be described. Each axle has a substantially fixed angularity with respect to its generally C-shaped steering arm, as is the case with the embodiments described above. As will become clear, the steering arms are coupled in a common region between the two axles. The coupling means here employed bears the designation 124 (see FIGS. 16 and 18) and, as is the case with the other embodiments, it couples the steering arms with freedom for relative pivotal movement, preferably with stiffness against lateral motion in the general direction of axle extension.

In this retrofit embodiment of the invention, the coupling means for interconnecting the steering arms is disposed slightly to one side of the vertical centerline of the bolster 104, in order that it may pass freely through one of the apertures 117 in the bolster, the other aperture 117 being used, in most cases, for a conventional brake rod.

Lateral forces between the two axles are exchanged through the coupling 124, and this coupling has a lateral stiffness which may also make a contribution to the yaw stiffness between the two axles. As was the case with the other embodiments, the coupling provides for coordination and balancing of steering moments between the two axles, as well as providing the lateral stiffness. Coupling 124 may be and preferably is of the type shown in FIG. 15, i.e., of the type used in the embodiment of FIGS. 13 and 14. However, the coupling is located differently than is the corresponding coupling of FIGS. 13 and 14. In the case of the retrofitted embodiment of FIGS. 16–22, the coupling passes through an aperture 117 (FIG. 18), which is provided in the bolster, and is located somewhat off center, rather than in the center as it appears in FIGS. 13 and 14. Specific description of the coupling 124 need not be repeated, (compare coupling shown at 14*b* in FIG. 15), other than to record the fact that elastomeric material 125, preferably rubber, is interposed between the telescoped members which define the coupling, and that a corresponding one of said telescoped members is fixed to each of the steering arms 122 and 123, as shown in FIG. 16. Thus, as was the case with preceding embodiments, the coupling 124, through which the steering moments are exchanged, has considerable lateral stiffness and an angular flexibility sufficient so that the two axles are free to assume positions radial of a curved track and free to adjust to track surface irregularities. As will be understood, it is important that this coupling pass freely and with clearance through the bolster so that it may be free for steering motions in a direction across or transversely of the truck and also that lateral motion of the truck parts, such as the bolster, may occur independently of the motion of coupling means 124 and its associated steering arms. Considered from another point of view, it will be seen that the construction is of such a nature that the coupling means and the associated steering arms are not affected by centrifugal forces transmitted to the bolster.

Turning now to the manner in which each axle is associated with its steering arm, and the latter with the side frames, it will be seen, particularly from FIGS. 19–22, that each steering arm, for example the steering arm shown at 122 (FIGS. 16 and 17), has a pair of spaced free end portions 126 which extend longitudinally of the truck in planes lying between the truck wheels, and the adjacent side frame. Each of these end portions is rigidly coupled to a bearing adapter 127 through the agency of high strength bolts shown in FIGS. 16 and 17 at 128, and which appear to best advantage in FIGS. 19 and 20. Provision of apertures 129 in the bearing adapter 127 (FIG. 19) suitable to receive the bolts, is a step characteristic of the preferred retrofitting procedure. A boss 130 is provided on each steering arm, in a position to confront the bearing adapter 127, and the aforesaid bolts extend through the boss. In such a construction, the usual bearing adapters are used, in effect, as extensions of the steering arms, which extensions are interposed between the side frame and the bearing assembly carried between the pedestal jaws of such side frame. The adapters move with the steering arms, and with respect to the side frames during axle steering.

As clearly appears in FIGS. 17 and 19, and as is the case in the illustrations of the AAR truck in FIGS. 26–28, the pedestal jaws shown at 111 are sized to receive the bearing assembly 112, the upper surface of which fits within a partially cylindrical downwardly presented surface of the bearing adapter 127 (FIG. 21). The bearing adapter has a substantially flat upper surface 131, as shown in FIGS. 19 and 20, while its lower surface is partially cylindrical as noted just above. The cylindrical, bearing-receiving surface has spaced arcuate flanges 132—132 which serve to axially locate the bearing assembly 112 with respect to the adapter, and to maintain the parts, in proper assembly. In this structure, the bearing adapter is provided with spaced keyways 133—133 shaped to receive, with some clearance, the projecting flanges 134—134 provided on the inward confronting surfaces of the pedestal jaws 111, as clearly appears in FIG. 21. Cooperation between these flanges and the keyways serves to position the bearing structure, and accordingly the wheelset, laterally with respect to the load-imposing side frames, while permitting freedom for wheelset steering motions. An end cap 135 (FIGS. 16 and 17) is bolted to the end of the axle and completes the assembly of bearing and axle.

As will be plain from the earlier description of the retrofitting method, each adapter 127, carried by its steering arm, is interpositioned between its corresponding bearing assembly 112 and the overlying surface 136 (FIG. 21) of the pedestal jaw, to thereby provide for pivotal steering motion of each wheelset and consequent sliding motion of each adapter with respect to the side frame. As is characteristic of this invention, yielding pivotal motion restraining means is introduced in load transmitting position between the bearing adapters 127 and the overlying surfaces 136 which define the base ends of the pedestal jaws.

Thus, in accordance with my invention, elastomeric material is interposed between the weight-carrying side frames and the bearing adapters which, in turn, form part of the steering arms, as will now be understood. In this manner, consistent with the embodiments already described, the elastomeric means flexibly restrains yawing motions of the coupled pair of wheelsets, i.e., provides restraint of the steering motions of the axles with respect to each other and thus restrains departure of the subtrucks (comprising the steering arms and their axles) from a position in which the wheelsets are parallel. This restraining means may, if desired, be provided only at the ends of that axle which is more remote from the center of the vehicle. However, it is frequently desirable to provide such restraint at the ends of each axle. Accordingly, the embodiment of FIGS. 16–17 shows restraint at each axle. It can, of course, be of different value at each axle, depending upon the particular truck design.

As best seen in FIGS. 17, 21 and 22, the restraining means takes the form of the elastomeric pad assemblies 137 (FIGS. 21 and 22), which are interposed between the upwardly presented flat surface 131 of each bearing adapter and the confronting lower surface 136 of the outboard end portions of each side frame, in the pedestal area of the latter. The assemblies 137 comprise an elastomeric, preferably rubber, pad 138 sandwiched between thin steel plates 139 and 140 and bonded thereto. The upper plate 139 has spaced flanges 141 and 142 (FIG. 22), between which is received the portions of the side frame which extend just above the flat surface 136 of the pedestal opening. This will be readily appreciated by reviewing FIGS. 21 and 22 in the environmental showing of FIG. 17. The lower plate 140 has oppositely directed flanging 143 at each end, interrupted at 144, to receive the tongues 145, projecting from the adapter, as shown in FIG. 19. The adapter, shown in perspective in that figure, has two such tongues extending from the upper portion of the adapter. When the parts are assembled (FIGS. 17 and 20), the pad assembly 137 lies upon the surface 131 with the tongues 145 fitted within the openings 144 provided in the flanging 143 of the lower plate 140. The flanges 141 and 142 of upper plate 139 serve, of course, to locate the pad assembly with respect to the side frame, as is seen in FIG. 17. As will now be understood, the pad assembly is so located and restrained, with respect to other elements of the structure, that the elastomeric pad 138 is subjected to shear forces when the wheelsets tend to pivot, thereby providing the desired restraint and stability at speed.

Fourth Embodiment and Retrofitting

Reference is now made to FIGS. 23 through 25 in which there is illustrated a modified retrofit arrangement in which the usual bearing adapter may be associated with the steering arm, to move therewith, without being bolted to the latter. In these figures, parts similar to those shown in FIGS. 19–22 bear similar reference numerals including the subscript a.

In this apparatus, the adapter 127a requires no drilled apertures, such as those shown at 129 in FIG. 19, being held to the steering arm 122a through the agency of a specially configured elastomeric pad assembly 137a which may be secured, conveniently by bolting, to the steering arm. This pad assembly is shown in FIG. 25, and comprises upper and lower plates 139a and 140a, respectively, between which is bonded a block of suitable resilient material 138a, for example rubber. As was the case with the earlier embodiment, the lower plate has opposed flanging 143a which span the width of the adapter and cooperate with its projecting tongues 145a, to position the adapter, and its axle-carrying bearing 112a with respect to the pad assembly.

Assembly 137a has a pair of tabs 146, each of which is drilled at 147. When the parts are assembled, these apertured tabs underlie the steering arm 122a in the manner most clearly shown in FIG. 23, from which the upper plate 139a has been omitted, in order that the cooperation between the adapter flanging 145a and the flanging 143a of the lower plate 140a, may not be obscured. Bolts 148 project through apertures provided in the steering arm and secure the arm to the tabs 146 of the lower plate. In this manner, the adapter is coupled to the steering arm through the interposed pad assembly. When the equipment is in use, as will now be understood, the side frame (not shown) lies upon the upper plate 139a, being received between its flanges 141a and 142a, thus to impose the load of the vehicle upon the steering arms and axles through the pads and adapters.

From the foregoing, it can readily be seen in what relatively simple manner the AAR truck may be retrofitted, by the addition of coupled steering arms and elastomeric restraining means in accordance with this invention. While such a truck may be retrofitted without effecting any change in the side frames, the axles may achieve radial position in somewhat sharper curves if the two side frames are modified to increase slightly the distance between the pedestal jaws 111, thereby to provide increasing clearance for longitudinal movement of the bearing assemblies, and the bearing adapters carried thereby, in the direction of the length of the side frames. Curving performance will also be enhanced if longitudinal stops S (see FIG. 21) are added along the outer edge of each pedestal opening to prevent the elastomeric pads 137 from migrating outward under the influence of repeated brake applications.

In retrofitting an existing truck in the manner shown in FIGS. 20–22, the wheelsets should be inspected, particularly for matched wheel sizes and to remove any rolledout extensions of the tread which might contact the steering arms. Also, it should be determined that the openings in the bolster 104 contain no casting flash which might interfere with the free movement of the steering arm coupling 124. In addition, it is important that the two side frames be of the same wheelbase, or "button" size, if these conditions are met, no difficulty should be encountered in accomplishing the retrofit.

BRAKE RIGGING

While it is possible to use standard AAR brake rigging, as shown in FIG. 26, with a retrofitted truck of the kind shown in FIGS. 16–18, (care being taken to ensure that rigging is so positioned as not to interfere with the free movement of the coupling 124) the retrofitted embodiment lends itself well to the improved braking which is described below with reference to FIGS. 7, 8 and 8a.

Making detailed reference to the unique braking apparatus characteristic of the invention and to the advantages which are achieved thereby. In prior brake apparatus commonly used in the railroad art, the brake beam is supported by an extension member which rides in a slot in the truck frame. This system has several substantial drawbacks. The friction created at the slot interferes with precise control of the force between the wheel tread and the brake shoe, and the radial distance between the friction face of the shoe and its point of support in the slot, results in an overturning moment on the brake shoe which, in turn, causes large variations in the unit pressure between the shoe and the wheel tread, along the length of the shoe face. Another problem with conventional brake rigging is the large lateral clearance between the brake beams and the car truck side frames. With conventional trucks this clearance is required to prevent high lateral forces which would occur if the distortion of the truck framing in curves is limited by contact between the brake shoes and the wheel flanges. The above problems can combine to produce unsymmetrical wear of the two wheels in each wheelset, the one wheel having excessive flange wear, the other having excessive wear of the tread, and in some cases wear of the outside corner of the wheel leading to overheating and occasional derailment due to wheel failure.

In the braking arrangement shown in FIGS. 7, 8 and 8a, these disadvantages are overcome, primarily because the association of the brake beams with the steering arms makes it possible virtually to eliminate uneven wear at the shoe and completely to prevent any contact between the shoes and the wheel flanges. Since the brake beams 24 are carried by hangers 27 which are supported in pad structures 28, formed integrally with the steering arms (instead of on the truck frames or bolster), and because of the fixed angular relationship between the wheelsets and the steering arms, the brake pads 26 always remain properly centered with respect to the wheel treads.

FIG. 8 shows how the proper choice of geometrical relationships can be used to provide two different values for the braking force B on the leading and trailing wheelsets. This compensates for the transfer of weight from the trailing to the leading wheelset during braking. Thus, providing this compensation reduces the risk of wheel sliding. The braking effect on the lead wheelset $B_L$ is made larger than the braking effect on the trailing wheelset, $B_T$, by choosing a centerline for the hanger structure 27 which is inclined with respect to a line t, which is tangent to the wheel surface at the center of the brake shoe face. Referring to the two force polygons which comprise FIG. 8a, it can be seen that the effect of the mentioned angle is to create an angle between the vectors $R_L$ and $B_L$, and the vectors $R_T$ and $B_T$. The presence of these angles causes the normal force $N_L$, between the shoe and the lead wheel, to be larger than the force $N_T$ between the shoe and the trailing wheel. It is necessary to have the same ratio between the normal forces N and the braking forces B, for both wheelsets, and the ratio is established by the coefficient of friction chosen for the brake shoe material and the steel face of the wheel.

The total force applied to the brakes is shown in the drawings by arrows appearing on the brake beam linkage in FIGS. 7 and 8. As shown by the force polygon, the braking force applied to the beam linkage at the leading, or right hand, wheelset is $F_2$, while the force applied to the linkage at the trailing wheelset, is represented in the polygon as the equal and opposite $F_1$. Since two brake shoes are actuated by each beam assembly, the arrow showing brake actuator force is labeled on the trailing wheelset as amounting to $2F_1$. As will be understood, this force can be supplied by any convenient conventional means, including for example, a connection extended through an aperture through the bolster such as the aperture 117 through which the conventional "throughrod" 108 previously extended. Such connection serves adapted to apply the force in the direction of the arrows shown on the center strut of the brake beam structure.

In retrofitted trucks spaced steering arm extensions 126 may extend outwardly of each end of the truck a distance sufficient to provide for application of the brakes at the outside surfaces of the wheels of each wheelset. These are the surfaces which, at any instant, are, substantially, the furthest removed from the center of the truck as measured in the direction of the truck travel. Such extensions have been incorporated in the embodiment of FIGS. 16 and 17 and it will be seen that the brakes 149 are fixedly carried by downwardly extending brake arms 150 which have special configuration to couple them pivotally to free, upwardly hooked, ends 151 of the extensions 126. This configuration is such that the upper end of each brake arm 150 is provided with a pair of vertically spaced flanges 152 which form a slot 153 (left side of FIG. 17) within which is received the steering arm extension 126 and its hooked end 151.

As is the case with the brake structure described above with respect to FIGS. 7, 8 and 8*a*, the brake beams 107*a* extend between and are associated with the shoe mounting structure in such manner that the position of each brake is fixed with respect to its corresponding wheel. This prevents brake misalignment and flange wear problems which characterize the prior art brake rigging in which the beams are carried by the side frames. Apparatus for actuating the brakes would, of course, be provided. This apparatus would serve to displace the brake beams 107*a* and 107*a*. The brake apparatus of FIGS. 16 and 17, like that shown in FIGS. 7, 8 and 8*a*, substantially reduces brake shoe wear and results in much safer braking.

FIFTH EMBODIMENT

The fifth embodiment is illustrated in drawings in FIGS. 29A, 29B, 29C, 29D, 30, 31, 32 and 33. The structure of the fifth embodiment is described below with particular reference to FIGS. 29A, 30, 31, 32 and 33; and the steering action of the fifth embodiment is thereafter described with particular reference to FIGS. 29A, 29B, 29C and 29D.

In connection with the general arrangement or structure of the fifth embodiment, it is first pointed out that this embodiment utilizes a truck structure incorporating two axled wheelsets, each of which is provided with a steering arm in accordance with the general principles hereinabove fully described. The fifth embodiment also incorporates linkage interrelating lateral motions of the vehicle body to the steering action of the wheelsets. As fully described hereinabove with reference to FIGS. 5A and 5E inclusive, the invention contemplates an interrelation between the lateral motion of the vehicle body and the steering motion of the wheelsets in the following manner. Thus, when travelling on straight or tangent track, if the vehicle tends to hunt or oscillate, as sometimes occurs, particularly at high speeds, the resultant lateral motion itself of the body of the vehicle is utilized, through the use of interconnecting linkage or tow bar mechanism, to introduce corrective steering action between the intercoupled wheelsets. As fully described above in connection with FIGS. 5A to 5E, the steering action introduced as a result of hunting of the vehicle body tends to counteract or diminish the hunting whether this occurs at either low or high speed or on curved or tangent track.

Moreover, when the truck of the fifth embodiment (FIGS. 29A to 33) is operating on a curved trackway above the Balance Speed, the vehicle body tends to move outwardly of the curve, and the linkage or tow bar mechanism automatically provides for diminution of the self-steering action of the wheelsets and the interconnected steering arms. When the vehicle is travelling on a curved rail path below the Balance Speed, the laterally inward movement of the vehicle tends to increase the steering action. These actions of the fifth embodiment, both on straight track and on curved track are further explained with reference to FIGS. 29A to 29D after description of the structure of the fifth embodiment, in connection with FIGS. 29A, 30, 31, 32 and 33, as follows.

In the fifth embodiment, the axles are indicated at 160 and 161, each axle having a pair of flanged wheels 162 adapted to ride on rails such as indicated at R in FIG. 30. The vehicle body is indicated at VB. In FIG. 29A, the diagrammatic indication of the rails at SR indicates a portion of trackway having straight rails.

Each wheelset is provided with a steering arm of the kind described above, these arms being indicated at 163 and 164, each steering arm carrying bearing adaptors cooperating the respective wheelsets in the manner described above. The truck further includes side frames 165 and 166, the ends of which rest upon the portions of the steering arms associated with the wheel bearings. A resilient pad 167 is located between each end of each side frame members 165 and 166, and serves the function described above for resiliently opposing departure of the wheelsets from parallel relation, under the influence of the self-steering action which occurs when the truck is riding curved trackway.

The side frames also have centrally located pads 168 which receive load from the vehicle body through the bolster indicated at 169. The bolster in turn receives the load of the vehicle body through cushions of known type indicated at 170. The position of the bolster with relation to the car body is maintained by the drag links 171, these links being flexibly joined to the vehicle body as indicated at 172.

With the arrangement of the major truck components, the bolster and the vehicle body in the manner described above, the bolster does not yaw relative to the vehicle body, but flexibility is permitted to accomodate lateral motions originating with lateral forces. Lateral motion between the truck side frames and the bolster is limited or controlled by the link 173 which is pivoted at 174 (see FIGS. 29A, 30 and 33) to the side frame 165 and which is pivoted at 175 with the bolster.

The major components of the truck structure briefly described above conform with generally known types of truck construction and many specific parts of such structures are also described hereinabove with reference to the embodiments previously described.

Turning now to the steering functions of the truck of the fifth embodiment, it is first pointed out that the steering arms are interconnected substantially midway between the axled wheelsets, by means of a joint indicated generally at 176 (see particularly FIGS. 31 and 33). This joint includes a pivot pin 177 and spherical ball and socket elements 178 and 179, with an intervening resilient element 180. Therefore the steering arm interconnection provides not only for pivotal motion of the steering arms with respect to each other about the axis of the pin 177, but also provides for angular shift of one of the wheelsets in a vertical plane with respect to the position of the other wheelset.

As fully brought out above, the steering arms and the interconnection thereof is provided in order to insure coordinated substantially equal and opposite yawing movement of the steering arms and thus also of the wheelsets under the influence of the self-steering forces.

Attention is now directed to the arrangement of the linkage interconnecting the steering arms and the vehicle body, in order to influence the self-steering action of the wheelsets when travelling on curved trackway and in addition when the vehicle body moves laterally relative to the truck framing.

The linkages employed in the fifth embodiment, as shown in FIGS. 29A to 33, include linkage parts serving the same fundamental functions as the linkage parts including tow bar 48 and associated mechanism, as described above with reference to the first structural embodiment shown in FIGS. 5 to 12. Moreover, the fundamental action of the linkage parts about to be described in connection with FIGS. 29A to 33 is essentially the same as the functioning of the first embodiment as described with reference to FIGS. 5A, 5B, 5C, 5D and 5E. However, the linkage now to be described as embodied in the fifth embodiment is a multiple linkage, instead of a single link as in the first embodiment, and this multiple linkage arrangement is adapted for use in various truck embodiments where clearance problems would be encountered if only a single tow bar link was employed as in the first embodiment.

In the following description of the multiple linkage arrangement of the fifth embodiment, particular attention is directed to FIGS. 29A, 30, 32 and 33. A lateral or double-ended lever 181 is centrally pivoted as indicated at 182 on the steering arm 163, this pivot 182 being spaced between the joint 176 between the two steering arms and the axle 160 of the outboard wheelset. A link 183 interconnects one end of the lateral lever 181 with a bracket 184 secured to and depending from the vehicle body VB, spherical pivot joints being provided at both ends of the link 183 to accomodate various motions of the connected parts. Similarly, the other end of the lateral lever 181 is connected by a link 185, with a bracket 186 secured to and depending from the vehicle body VB. Pivot or flexible joints are again provided at the ends of the link 185.

A reference link 187 is provided between the link 185 and the bolster 169. As best seen in FIGS. 29A and 33, the reference link is pivotally connected at one end with the link 185 and pivotally connected at its other end with a bracket 188 adapted to be mounted on the underside of the bolster 169. The ends of the link 187 are desirably flexibly and pivotally connected with the link 185 and the bracket 188, and in certain embodiments it is provided with several alternative positions for adjustment of its longitudinal position of the link 187 with respect to the link 185 and the bracket 188. For this latter purpose, several different fastening apertures are provided in the bracket 188 and in the link 185, as clearly illustrated in FIGS. 29A and 33. This permits adjustment of the influence of lateral vehicle body motion on the steering action of the interconnected wheelsets.

Pivoted links 189 between the steering arm 163 and the side frames 165 and 166 aid in maintaining appropriate interrelationships of those parts under the influence of various lateral and steering forces.

FIFTH EMBODIMENT STEERING ACTION

The steering action of the fifth embodiment is illustrated in FIGS. 29A to 29D and reference is first made to FIGS. 29A and 29B which illustrate the steering action occurring as a result of lateral movement of the vehicle body relative to the truck framing on straight track at high speeds. As seen in FIGS. 29A and 29B, the track on which the truck is travelling comprises straight rails as indicated at SR. In FIG. 29A, all of the parts of the truck including the axled wheelsets, the steering arms and all of the linkage interconnecting the vehicle body and the steering arms are located in the mid or neutral position, representing a stable state of travel on straight track without hunting or oscillation. All of the truck parts are thus located symetrically with respect to the centerline of the vehicle as shown on the figure.

In FIG. 29B, the vehicle body is shown as being shifted in position as indicated by the arrow LF, thereby shifting the centerline of the vehicle upwardly in the figure as is indicated. FIG. 29B thus shows the vehicle body VB shifted laterally with respect to the variuos truck components, including the bolster 169. Because of the presence of the link 187 between the link 185 and the bracket 188 which is carried on the bolster 169, this lateral motion of the vehicle body with respect to the truck parts introduces a steering motion between the axled wheelsets, so that the axled wheelsets now assume relatively angled positions, being closer together at the upper side of FIG. 29B than at the lower side thereof. This results in introduction of a steering action which tends to neutralize the wheel conicity which in turn minimizes steering activity on straight track which otherwise could lead to hunting of the truck or car body.

FIGS. 29C and 29D show a comparison similar to that shown in FIGS. 5C and 5D. The activity of the steering parts when travelling on a curved trackway as indicated by the curved rails CR. In FIG. 29C, the effect of the self-steering action of the wheelsets is shown in the absence of lateral displacement of the vehicle body, i.e. with the vehicle travelling at the Balance Speed. It will be seen from this figure that the curved track has set-up steering forces which have caused the wheelsets to assume substantially radial positions with respect to the curved track, the angle of the wheelsets with respect to each other representing a substantial departure from parallelism as is plainly evident from the figure.

In FIG. 29D, the vehicle body has been shown shifted again in the direction indicated by the arrow LF as would occur by outward movement of the body when travelling above the Balance Speed. The effect of this is to shift the position of the steering arms in a direction to diminish the steering action. As appears in FIG. 29D, the steering arms and the wheelsets are in positions representing an appreciable reduction in the angle between the wheelsets.

The arrangement of FIGS. 29A to 33 also functions for the purposes described above with respect to FIG. 5E.

In the fifth embodiment, the linkage serves to influence the steering action as in the single tow bar embodiments previously described and also serves as tow bar linkage, as in the other embodiments, but in the fifth embodiment, the linkage constitutes multiple tow bar linkage. It is also to be understood that separate linkages serving the steering and tow bar functions may be employed.

SIXTH EMBODIMENT

FIGS. 34, 35 and 36 illustrate various aspects of the sixth embodiment. Only certain parts are shown in these figures, but it is to be understood that the arrangement is to be employed in association with other truck features, for instance, the linkages and various parts included in the fifth embodiment of FIGS. 29A to 33.

In general, what is included in the sixth embodiment comprises a special form of mechanism adapted to resist relative deflection of the steering arms of the truck. It will be recalled that in various of the embodiments described above, resilient pads are employed between the steering arms and the side frames of the truck, such pads being indicated by the numeral 30 in FIGS. 5, 6 and 7, and also being indicated by the numeral 167 in FIG. 29A and other figures of the fifth embodiment. Those resilient pads yieldingly resist or oppose relative deflection of the steering arms and serve to exert a force tending to return the steering arms to the positions in which the wheelsets are parallel to each other.

I have found that it is desirable to employ in combination with such resilient pads some additional means for resisting relative deflection of the steering arms; and a mechanism for this purpose is illustrated in FIGS. 34, 35 and 36. This means provides non-linear restraint of interaxle and truck frame yaw motions as provided by this invention according to FIG. 3.

In FIGS. 34 and 35, the steering arms are indicated at 163 and 164 and the steering arm interconnecting joint is indicated at 176 (these reference numerals being the same as used in the illustration of the fifth embodiment).

A pair of devices generally indicated at 190 are employed in the sixth embodiment, one of these devices being shown in section in FIG. 35. Each of these devices comprises a cylindrical spring casing 191 in which a helical compression spring 192 is arranged, the spring reacting between one end of the casing 191 and also against an adjustable stop device 193 arranged at the other end of the device. A cylindrical cup 194 is positioned within the spring and has a flange 195 against which the spring reacts, urging the cup flange 195 against the adjustable stop 193. A plunger 196 extends into the cup 194 and is adjustably associated with the rod 197 by means of the threaded device 198. At the other end of the system a rod 199 is connected with the base end of the cylinder 191 and the two rods 197 and 199 are extended toward the steering arms 163 and 164, as clearly appears in FIG. 34. Each of these mounting rods is connected with the associated steering arm by means of a pivot 200 carried by a fitting 201 which is fastened to the respective steering arms. A resilient device, such as a rubber sleeve 202 serves as the interconnecting element between the associated rod and its pivot 200. The resilient sleeves 202 are capable of deflection and are intended to contribute the relatively high resistance to the initial deflection of the steering arms from the parallel axle position in the manner explained more fully below with reference to FIG. 36.

The spring 192 is preloaded or precompressed between the base of the cylinder 191 and the flange 195 of the cup 194. The plunger 196 is separable from the cup 194 but is positioned in engagement with the base of the cup in the condition shown in FIG. 35. The length of the assembly shown by FIG. 35 is adjusted by the threaded connection between parts 196 and 198 so that the sleeves 202 are brought approximately to point A in FIG. 36 when the axles are parallel. When the steering arms are separated at the side thereof to which the respective device 190 is located, the load in the bushing 202 is reduced and will ultimately become zero and the plunger 196 will be partially withdrawn from the cup 194. An air cylinder under a preset pressure may alternatively be used in place of the spring 192.

When the steering arms deflect toward each other at one side, the deflection resisting device at that side comes into action to resist the deflection. Because of the presence of the resilient or rubber sleeves 202, the initial portion of the deflection builds up to a substantial value very rapidly even with a relatively small amount of deflection. When the load exceeds the preload in spring 192, it will be compressed to a shorter length than shown, with a more gradual increase in the resistance than would otherwise be required to obtain the same deflection in sleeves 202.

The combined use of both the resilient sleeves 202 and the preloaded spring 192 results in a pattern of resistance to steering arm deflection which is generally diagrammed in the graph of FIG. 36. The total range of deflection of the resilient sleeves 202 is relatively small, as compared with the total range of deflection provided by the helical spring 192, but the rate of increase of resistance contributed by the resilient sleeves 202 is relatively high per unit of deflection; and the rate of increase of resistance contributed by the spring 192 is relatively low per unit of deflection. This net result is indicated in the graph of FIG. 36. The combined effect of the two such assemblies is to produce the force (R) - deflection ($\theta_B$) characteristic shown in FIG. 3.

In the normal position of the parts, for small angular motion of the axles, the end of the plunger 196 will exert a nominal force on the base of the cup 194 and only the resilient sleeves 202 will be active.

The high rate of increase of resistance in the initial portion of the deflection is important in providing high speed steering stability on straight track and in gradual curves. The change to a lesser rate of increase for large deflections prevents wheel/rail flange force and the forces within the truck assembly from becoming excessive in sharp curves.

SUMMARY

In summary, the apparatus shown in the several embodiments of the invention virtually eliminates flange contact in many curves and greatly reduces flange forces when contact does occur. In addition, excellent high speed stability is achieved, with resultant minimization of wear and cost problems. As will now be understood, these advantages are achieved (1) by providing restraining means between the side frames and the steering arms of a truck, to restrain yawing motion of the axles, by (2) providing restraining means reacting between the steering arms, (3) by having the steering arms intercoupled through further restraining means, and (4) by providing suitable restraining means between the side frames, or their associated bolster, and the body of the vehicle. Use of equal restraint between the side frames and the steering arms at each side, e.g., the four pads 30 in the embodiment of FIGS. 5 and 6, has the advantage of minimizing parts inventory and simplifying assembly and maintenance. Use of unequal restraint, which in some instances can be done by eliminating restraining pads at one axle, can further improve the radial steering action desired during curving.

With especial reference to the apparatus of FIGS. 16–28, it will be readily understood in what simple manner existing prior art trucks may be retrofitted to achieve the advantages of this invention.

Limiting the side frame car body forces, as for example by the use of a tow bar, such as shown in FIG. 5, is highly advantageous for reasons which will now be understood.

The invention has been analyzed mathematically, and illustrated schematically, as well as being shown and described with reference to several structural embodiments. While the emphasis herein has been on the use of elastomeric restraints, similar advantages can be achieved by the use of resilient steel springs and/or air springs. The use of elastomeric restraints in many locations, however, has the advantage of simultaneously carrying other loads such as the car body weight, while providing both vertical and lateral flexibility in the suspension.

In general, however, it will be understood that the use of steel restraints, or of such other structural modifications as properly come within the terms of the appended claims, are within the scope of this invention.

I claim:

1. A vehicle truck assembly comprising: at least two axle-borne wheelsets; main truck framing having a pair of spaced generally parallel load bearing side frame elements; at least one flexible cross-tie interconnecting the spaced side frame elements; a pair of steering arms each having spaced portions journalling an axle-borne wheelset and having load bearing connection with the truck framing in the regions of said spaced portions of the steering arms, each steering arm having a portion extending from its associated wheelset to a common region substantially midway between the two axles; means in said common region pivotally intercoupling said steering arms independently of the load bearing truck framing and providing for coordinated substantially equal and opposite yawing movements of the steering arms and consequent positioning of the associated axles substantially radially of a curved path; resilient means interposed between said framing and at least one of said steering arms resiliently opposing departure of said steering arms from a position in which said wheelsets are parallel; and tow bar means extending generally longitudinally of the truck said tow bar means having an intermediate fulcrum pivotally coupled to said flexible cross-tie in the mid region thereof, with freedom for yawing movements of said tow bar means about said intermediate fulcrum, one end portion of said tow bar means having means pivotally connected with the car body with which the truck is associated, and the other end portion having means pivotally connected to one of said steering arms.

2. A vehicle truck assembly comprising: at least two axle-borne wheelsets; load bearing truck framing; a pair of steering arms each having spaced portions journalling an axle-borne wheelset and having load bearing connection with the truck framing in the regions of said spaced portions of the steering arms, each steering arm having a portion extending from its associated wheelset to a common region substantially midway between the two axles; means in said common region pivotally intercoupling said steering arms independently of the load bearing truck framing and providing for coordinated substantially equal and opposite yawing movements of the steering arms and consequent positioning of the associated axles substantially radially of a curved path; resilient means interposed between said framing and at least one of said steering arms resiliently opposing departure of said steering arms from a position in which said wheelsets are parallel; and tow bar means extending generally longitudinally of the truck, said tow bar means having an intermediate fulcrum resiliently and pivotally coupled to the truck framing between the ends of the tow bar means, with freedom for yawing movements of said tow bar means about said intermediate fulcrum, a first end portion of said tow bar means having means pivotally connected with the vehicle body with which the truck is associated, and the second end portion having means pivotally connected to one of said steering arms.

3. A vehicle truck assembly as defined in claim 2 in which said truck assembly is located near one end of the car body, in which the means pivotally connecting said first end portion of the tow bar means to the vehicle body is offset longitudinally of the vehicle body closer to the center of the vehicle body than said means intercoupling said steering arms; and in which the means pivotally connecting said second end portion of the tow bar means provides pivotal connection with the steering arm which is associated with the wheelset which is more remote from the center of the vehicle.

4. A vehicle truck assembly as defined in claim 3 in which the means for pivotally connecting said first end portion of the tow bar means with the vehicle is offset from said intermediate fulcrum of the tow bar means a distance greater than the offset of the means for pivotally connecting said second end portion of the tow bar means to the steering arm.

5. A truck assembly for use with a railway vehicle on which the truck is adapted to be mounted in a position between the center and an end of the body of the vehicle, the truck assembly comprising at least two axle-borne wheelsets, load bearing truck framing pivotally movable about a vertical axis with respect to the vehicle body, a steering arm for each wheelset having load bearing portions with axle bearings movable with respect to the framing in the steering sense, means pivotally interconnecting the steering arms in the region between the axles independently of the load bearing framing and enforcing coordinated substantially equal to opposite steering motions of the wheelsets independently of the truck framing, resilient means deflectable but resiliently opposing departure of said steering arms from a position in which the wheelsets are parallel, and linkage connected with at least one of the steering arms, with the vehicle body and with said load bearing truck framing and including means responsive to displacement of the vehicle body generally laterally with respect to the truck framing to move the means pivotally interconnecting the steering arms in the opposite lateral direction.

6. A truck assembly as defined in claim 5 in which said linkage includes means pivotally connecting the linkage to the truck framing, and further in which the linkage further includes means pivotally connecting the linkage to the body of the vehicle on which the truck is mounted.

7. A truck assembly for use with a railway vehicle on which the truck is adapted to be mounted in a position between the center and an end of the body of the vehicle, the truck assembly comprising at least two axle-borne wheelsets, load bearing truck framing pivotally movable about a vertical axis with respect to the vehicle body, a steering arm for each wheelset having load bearing portions with axle bearings movable with respect to the framing in the steering sense, means pivotally interconnecting the steering arms in the region between the axles independently of the load bearing framing and enforcing coordinated substantially equal and opposite radial steering motions of the wheelsets independently of the truck framing when the vehicle is travelling a curved rail path, resilient means interposed between the framing and at least one of the steering arms, the resilient means being deflectable but resiliently opposing departure of said steering arms from a position in which the wheelsets are parallel to each other, and tow bar linkage pivotally connected with at least one of the steering arms and with the vehicle body and limiting relative longitudinal movement of the steering arms in a direction fore-and-aft of the vehicle body and thereby limit deflection of said resilient means in a direction fore-and-aft of the vehicle.

8. A truck assembly as defined in claim 7 in which the tow bar linkage includes means interconnecting the linkage with the truck framing and with the vehicle on which the truck is mounted, the interconnecting means being responsive to outward lateral displacement of the vehicle body when travelling on a curved rail path and acting to partially counteract the coordinated substantially equal and opposite radial steering forces established by the pivotally interconnected steering arms.

9. A truck assembly for use with a railway vehicle on which the truck is adapted to be mounted in a position between the center and an end of the body of the vehicle, the truck assembly comprising at least two axle-borne wheelsets, load bearing truck framing pivotally movable about a vertical axis with respect to the vehicle body, a steering arm for each wheelset having load bearing portions with axle bearings movable with respect to the framing in the steering sense under the influence of radial steering forces when travelling a curved rail path, means pivotally interconnecting the steering arms in the region between the axles independently of the load bearing framing and enforcing coordinated substantially equal and opposite steering motions of the wheelsets independently of the truck framing, resilient means deflectable but resiliently opposing departure of said steering arms from a position in which the wheelsets are parallel and linkage connected with at least one of the steering arms, with the truck framing and with the vehicle body and including means responsive to lateral displacement of the vehicle body to move the means pivotally interconnecting the steering arms in the opposite lateral direction.

10. A truck assembly as defined in claim 9 and further including vehicle suspension means opposing lateral displacement of the vehicle body relative to the truck framing.

11. A truck assembly as defined in claim 10 in which the vehicle suspension includes yieldable means resisting lateral displacement of the vehicle body relative to the truck framing.

12. A truck assembly for use with a railway vehicle on which the truck is adapted to be mounted in a position between the center and an end of the body of the vehicle, the truck assembly comprising at least two axle-borne wheelsets, load bearing truck framing pivotally movable about a vertical axis with respect to the vehicle body, the truck framing having resilient vehicle body suspension means providing freedom for lateral displacement of the body with respect to the truck framing when travelling above or below the balance speed on a curved rail path, a steering arm for each wheelset having load bearing portions with axle bearings movable with respect to the framing in the steering sense, means pivotally interconnecting the steering arms in the region between the axles independently of the load bearing framing and enforcing coordinated substantially equal and opposite steering motions of the wheelsets independently of the truck framing when the vehicle is travelling a curved rail path, resilient means interposed between the framing and at least one of the steering arms, the resilient means being deflectable but resiliently opposing departure of said steering arms from a position in which the wheelsets are parallel to each other, and linkage connected with at least one of the steering arms and with said load bearing truck framing and including means responsive to forces incident to travel on a curved rail path at a speed above or below the balance speed to modify the coordinated substantially equal and opposite radial steering forces established by the pivotally interconnected steering arms.

13. A truck assembly for use with a railway vehicle on which the truck is adapted to be mounted in a position between the center and an end of the body of the vehicle, the truck assembly comprising at least two axle-borne wheelsets, load bearing truck framing pivotally movable about a vertical axis with respect to the vehicle body, the truck framing having resilient vehicle body suspension means providing freedom for lateral displacement of the body with respect to the truck framing when travelling above or below the balance speed on a curved rail path, a steering arm for each wheelset having load bearing portions with axle bearings movable with respect to the framing in the steering sense, means pivotally interconnecting the steering arms in the region between the arms independently of the load bearing framing and enforcing coordinated substantially equal and opposite steering motions of the wheelsets independently of the truck framing when the vehicle is travelling a curved rail path, resilient means interposed between the framing and at least one of the steering arms, the resilient means being deflectable but resiliently opposing departure of said steering arms from a position in which the wheelsets are parallel to each other, and linkage connected with at least one of the steering arms and with said load bearing truck framing and including means responsive to forces incident to travel on a curved rail path at a speed above the balance speed to partially counteract the radial steering forces established by the pivotally interconnected steering arms.

14. A truck assembly as defined in claim 12 in which said linkage is pivotally mounted with respect to the truck framing and also with respect to the body of the vehicle.

* * * * *